US007387221B2

(12) United States Patent
Masuda

(10) Patent No.: US 7,387,221 B2
(45) Date of Patent: Jun. 17, 2008

(54) FLUID DISCHARGE PUMPING APPARATUS

(76) Inventor: Masatoshi Masuda, 2, 9-banchi, Takada-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 658 days.

(21) Appl. No.: 10/811,406

(22) Filed: Mar. 26, 2004

(65) Prior Publication Data

US 2004/0208750 A1 Oct. 21, 2004

(30) Foreign Application Priority Data

Mar. 27, 2003 (JP) ..... 2003-087958

(51) Int. Cl.
*F04B 9/02* (2006.01)

(52) U.S. Cl. ..... 222/333; 222/309; 141/116; 417/559; 417/566; 417/571

(58) Field of Classification Search ..... 222/309, 222/333, 41–50; 141/116; 417/559, 563, 417/564, 566, 569, 571
See application file for complete search history.

(56) References Cited

U.S. PATENT DOCUMENTS 2,415,419 A * 2/1947 Cozzoli ..... 417/362
4,159,784 A 7/1979 D'autry
4,230,160 A * 10/1980 Buckley ..... 141/116
4,456,152 A * 6/1984 Young et al. ..... 222/309
4,509,904 A 4/1985 MacAskill et al.
4,856,967 A 8/1989 Jones
5,067,531 A * 11/1991 Herzog ..... 141/116
5,769,136 A * 6/1998 Kanematsu et al. ..... 141/129
5,865,226 A * 2/1999 Sweeney ..... 141/258

FOREIGN PATENT DOCUMENTS

FR 2 732 315 A 10/1996
JP 2003-061560 3/2003
WO WO 00/32932 6/2000

* cited by examiner

*Primary Examiner*—J. Casimer Jacyna
(74) *Attorney, Agent, or Firm*—Katsuhiro Arai

(57) ABSTRACT

A fluid discharge pumping apparatus includes: a drive mechanism; a cylinder; an outflow valve mechanism and an inflow valve mechanism coupled to the cylinder; a piston member inside the cylinder; and a piston-supporting member attached to the piston member driven by the drive mechanism to move the piston member. The inflow valve mechanism opens when the interior of the cylinder is depressurized, whereas the outflow valve mechanism opens when the interior of the cylinder is pressurized.

23 Claims, 21 Drawing Sheets

FLUID DISCHARGE PUMPING APPARATUS

BACKGROUND OF THE INVENTION

The present invention relates to a fluid discharge pumping apparatus, which is used for discharging a fluid stored inside a cylinder, which comprises an inflow valve mechanism and an outflow valve mechanism, in a given amount to the outside of the cylinder.

Japanese Patent Laid-open No. 2003-61560 discloses such a fluid discharge pumping apparatus. The apparatus comprises (i) a piston pumping mechanism comprising a pump cylindrical body having a discharge port, a piston body having a supply port, and a moving mechanism which moves the pump cylindrical body and the piston body relatively to each other to covey a supply material from the supply port to the discharge port through the piston body and the pump cylindrical body; (ii) a discharge-side valve mechanism comprising a discharge flexible tube provided in the middle of a discharge path connected to the discharge port, and a discharge-side crimping mechanism for crimping the discharge flexible tube; (iii) a supply-side valve mechanism comprising a supply flexible tube provided in the middle of a supply path connected to the supply port, and a supply-side crimping mechanism for crimping the supply flexible tube; and (iv) a valve controller which controls opening/closing of the discharge-side valve mechanism and the supply-side valve mechanism alternately according to a relative moving direction of the pump cylindrical body and the piston body. This configuration makes possible to discharge a fixed amount of a supply material stored in a supply region to a discharge region.

However, the apparatus requires the two crimping mechanisms and the valve controller for controlling opening/closing timing of the discharge-side valve mechanism and the supply-side valve mechanism alternately according to a relative moving direction of the pump cylindrical body and the piston body. Consequently, such complex mechanisms require a large and unwieldy apparatus.

SUMMARY OF THE INVENTION

The present invention can solve the above-mentioned problem in an embodiment, although the present invention is not limited by the above. Among others, a object of the present invention is to provide a fluid discharge pumping apparatus capable of discharging a fluid stored inside a cylinder in a given amount to the outside of the cylinder while the apparatus is manufactured at low cost and has a simple configuration.

The present invention can be used in various ways including, but not limited to, embodiments described below.

In an embodiment, the present invention provides a fluid discharge pumping apparatus comprising: (i) a drive mechanism; (ii) a cylinder having a discharge port at a lower end, a supply port on a side in the vicinity of discharge port, and a top opening; (iii) an outflow valve mechanism coupled to the discharge port of the cylinder; (iv) an inflow valve mechanism coupled to the supply port of the cylinder; (v) a piston member capable of reciprocating inside the cylinder; and (vi) a piston-supporting member attached to the piston member and extending through the top opening of the cylinder and coupled to the drive mechanism, wherein the piston-supporting member is driven by the drive mechanism to move the piston member in a predetermined range inside the cylinder where the piston member does not block the inflow valve mechanism, wherein the inflow valve mechanism opens when an interior of the cylinder is depressurized, whereas the outflow valve mechanism opens when the interior of the cylinder is pressurized. In the above simple configurations, by simply operation, a predesignated amount of fluid can be constantly discharged from the cylinder.

In an embodiment, the apparatus may further comprise a fluid-storing container which is connected to the supply port, wherein a fluid stored in the fluid-storing container flows into the interior of the cylinder through the inflow valve mechanism and is discharged from the outflow valve mechanism. By using a fluid-storing container which is to be attached to the cylinder, no complicated supply mechanism is required. Simply by attaching a fluid-storing container and replacing it with another fluid-storing container if the previous container is empty, fluid discharging operation can be continued. Further, changing fluid can easily be accomplished by using a different fluid-storing container. As long as the attachment of the container is fitted in the supply port, any container can be attached to the supply port. Further, if a separate attachment is used between the container and the supply port, the container can be attached to the supply port regardless of the shape of the container neck. Additionally, it is also possible that the supply port is connected to a fluid tank via a pipe. The fluid can be any suitable fluid including high or low consistency foods, cosmetics, drugs, industrial materials in any suitable form including liquid, slurry, cream, paste, gel, emulsion, gas-containing flowable mixture, or a mixture of the foregoing. The fluid can be solid at room temperature as long as it becomes flowable when being discharged. Thus, the cylinder can be provided with a heater or cooler (e.g., water jacket).

The inflow valve mechanism may be attached to the fluid-storing container or may be attached to the supply port.

An axis of the inflow valve mechanism may be angled with respect to an axis of the cylinder. Further, in the above, an axis of the outflow valve mechanism is preferably aligned with an axis of the cylinder. However, the axis of the inflow valve mechanism and the axis of the outflow valve mechanism can be aligned with each other, and the axis of the cylinder is angled with respect to the axis of the inflow valve mechanism or the outflow valve mechanism. In this case, the axis of the inflow valve mechanism or the outflow valve mechanism may be arranged in a generally vertical direction, and the axis of the cylinder can be slanted. If the axis of the cylinder and the axis of the outflow valve mechanism are aligned, the axis may be arranged in a generally vertical direction, and the axis of the inflow valve mechanism may be slanted. In another embodiment, the axis of the outflow valve mechanism may be arranged in a generally vertical direction, and the axis of the cylinder and the axis of the inflow valve mechanism may be arranged in a V-shape. Additionally, when the apparatus further comprises a connection mechanism to detachably connect a fluid-receiving container to the discharge port of the cylinder, the axis of the outflow valve mechanism need not be arranged in a generally vertical direction.

In an embodiment, the piston-supporting member can be detachably coupled to the drive mechanism, so that a piston-supporting member of different length can be attached. The piston-supporting member can be connected directly to the drive mechanism or via another supporting member. Any suitable latching or press-fitting mechanism can be adopted to accomplish the detachable connection.

Further, in an embodiment, the drive mechanism may comprise a motor, gears, and a ball screw, wherein the piston-supporting member is engaged with the ball screw. For example, the ball screw may be engaged with the motor via the gears, and may be disposed parallel to the piston-supporting mechanism, so that a controller can control revolution of the motor and change a traveling stroke of the piston-supporting member to change a fluid discharge amount. However, descending and ascending motion can be achieved by any suitable mechanism other than the ball screw. The driving mechanism can preferably be achieve by an electric motor but can be achieved by a user himself with a cantilever mechanism or cam mechanism, for example. When a control panel is use, it can be placed in the housing of the driving mechanism or separately from the housing (e.g., a remotely operating system).

A housing for the drive mechanism can also be used, wherein the housing is provided with a cylinder-supporting member, and the cylinder is detachably connected to the housing via the cylinder-supporting member, so that a cylinder of different size and different shape can be attached and also the height of a discharging point can be adjusted according to the height of a fluid-receiving object. Any suitable fluid-receiving object can be used regardless of its shape, size, material, and intended use. The fluid-receiving object can be placed on a conveyer. Any suitable latching or press-fitting mechanism can be adopted to accomplish the detachable connection.

The fluid-storing container can be attached to the supply port in various ways. For example, if a neck portion of the container has threads and the supply port has threads on an inner wall, they can be fitted. The neck and the supply port can be press-fitted in any suitable form. Further, if the supply port has threads on an outer wall, a connection mechanism having threads on an inner wall can be used to connect both the neck and the supply port. Further, a combination of a groove and a protrusion can be used (e.g., two protrusions or followers provided in the neck are fitted in a groove formed in the supply port).

In an embodiment, the outflow valve mechanism and the inflow valve mechanism may be one-way valves which respectively comprise a resin valve seat having an opening portion, and a resin valve body having a shape corresponding to a shape of the opening portion, wherein the valve body closes the opening portion when no pressure is exerted, and the valve body moves to open the opening portion when the interior of the cylinder is pressurized. Various valve mechanisms can be used. The valve body, the valve seat, and the opening portion are preferably disposed co-axially. In an embodiment, the valve mechanism comprises a valve body, a valve seat, and a connecting member which movably connects the valve body to the valve seat, wherein the connecting member urges the valve body against the valve seat, and when the pressure of the interior of the cylinder exceeds the urging forth, the valve moves and opens the opening of the valve seat. The connecting member can comprise multiple members. Further, in an embodiment, the valve body and the valve seat are integrated or assembled to provide a single valve mechanism unit.

The present invention also provides an embodiment wherein a fluid discharge pumping apparatus comprises: (a) a drive mechanism to which a piston-supporting member is attached, which reciprocates in a generally vertical direction; (b) a cylinder disposed in a generally vertical direction, said cylinder having a discharge port at a lower end, a supply port on a side in the vicinity of discharge port, and a top opening, wherein the discharge port is provided with a one-way valve, and the supply port is provided with a one-way valve; and (c) a piston member capable of reciprocating inside the cylinder, wherein the piston-supporting member is attached to the piston member through the top opening of the cylinder, and the piston-supporting member moves the piston member along an axis of the cylinder, wherein the one-way valve at the supply port opens when the piston moves upwards, whereas the one-way valve at the discharge port opens when the piston moves downwards. In the above, the foregoing various embodiments can be applied independently of each other.

For purposes of summarizing the invention and the advantages achieved over the related art, certain objects and advantages of the invention have been described above and will be described below. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

Figure 1:
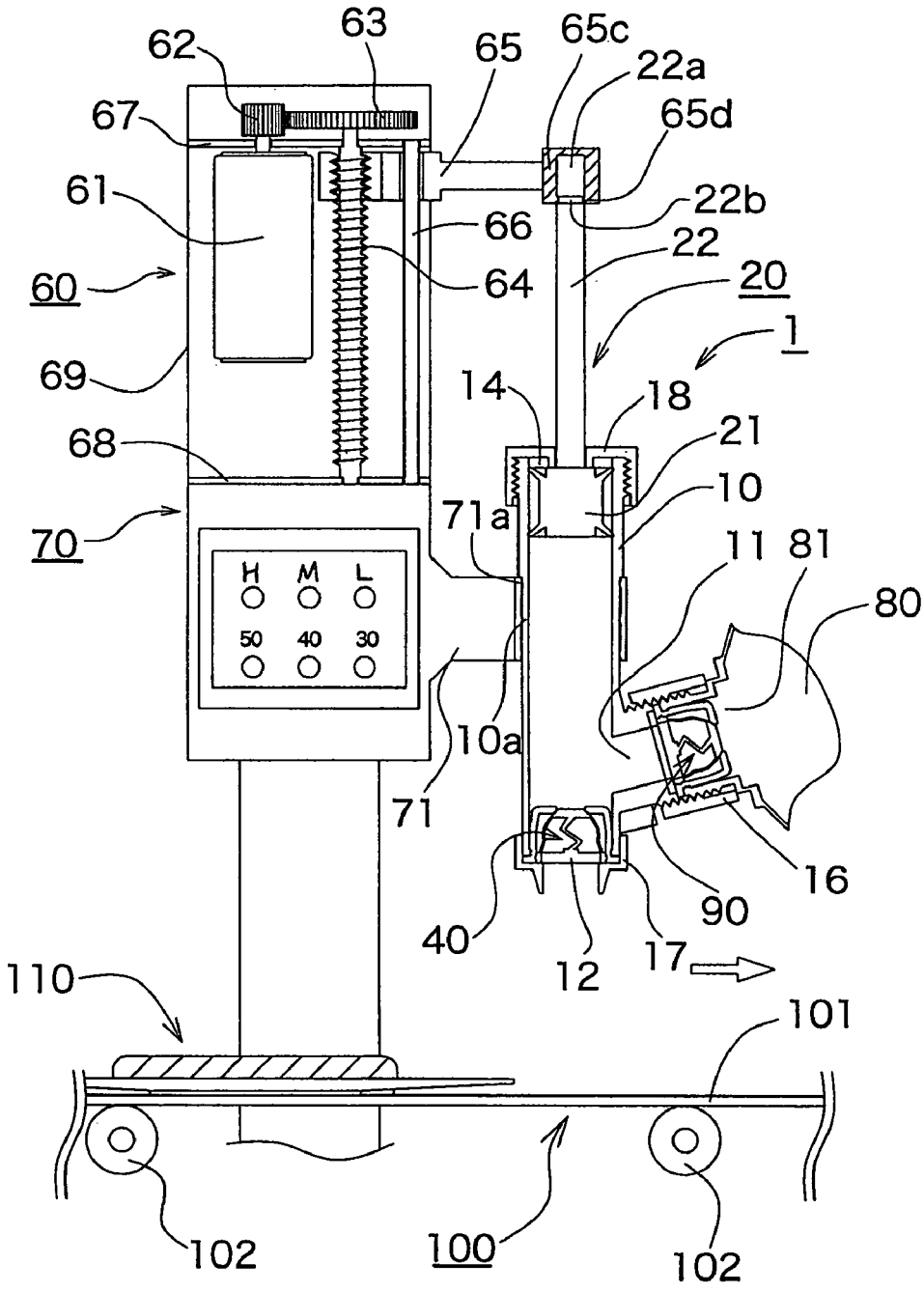
FIG. 1 is an explanatory diagram of an embodiment of a fluid discharge pumping apparatus according to the present invention.

Explanation of symbols used is as follows: 1: Fluid discharge pump; 10: Cylinder; 10*a*: Portion to be gripped; 11: Inflow entrance; 12: Outlet head; 13: Piston-traveling portion; 14: Piston member insertion slot; 15: Inner circumference; 16: Nut; 17: Fixing member; 18: Restricting member; 20: Piston member; 21: Piston; 21*a*: Contact portion; 22: Piston-supporting shaft; 22*a*: End portion; 22*b*: Concave portion; 40: Outflow valve mechanism; 41: Valve portion; 41*a*: Valve body; 41*b*: Supporting portion; 41*c*: Connecting portion; 41*d*: Elbow-shaped bend; 41*e*: Convex portion; 42: Valve seat portion; 42*a*: Opening portion; 42*b*: Concave portion; 42*c*: Fixing portion; 60: Motor drive mechanism; 61: Motor; 61*a*: Rotating shaft; 62: First gear; 63: Second gear; 64: Ball screw; 64*a*: Upper end portion; 64*b*: Lower end portion; 65: Piston-supporting member; 65*a*: Male-screw portion; 65*b*: Guide hole; 65*c*: Piston-supporting portion; 65*d*: Convex portion; 66: Guide member; 66*a*: Upper end portion; 66*b*: Lower-end portion; 67: Upper shroud; 68: Lower shroud; 69: Chassis; 70: Control portion; 71: Cylinder-supporting member; 71*a*: Gripper; 71*b*: Convex portion; 80: First fluid-storing container; 81: Opening portion 82: Fluid-storing portion; 83: Insertion portion; 90: Inflow valve mechanism; 100: Belt conveyor system; 101: Belt; 102: Roller; 110: Object to which a fluid is applied; 120: Second fluid-storing container; 121: Opening portion; 130: Valve member; 130*a*: Valve body; 130*b*: joining portion; 130*c*: Underside; 130*d*: End face; 140: Valve seat member; 140*a*: Valve seat portion; 140*b*: Valve member supporting portion; 140*c*: Connecting portion; 140*d*: Opening portion; 140*e*: Elbow-shaped bend; 140*f*: Horizontal surface; 140*g*: Vertical surface; 140*h*: Groove portion; 150: Valve mechanism; 160: Outflow valve mechanism; 161: Valve portion; 161*a*: Valve body; 161*b*: Supporting portion; 161*c*: Connecting portion; 161*d*: Elbow-shaped bend; 161*e*: Reinforcing portion; 162: Valve seat portion; 162*a*: Opening portion; 162*b*: Concave portion; 170: Inflow valve mechanism; Valve mechanism; 180: Outflow valve mechanism; 181: Valve portion; 181*a*: Valve body; 181*b*: Supporting portion; 182: Valve seat portion; 182*a*: Valve body supporting portion; 182*b*: Valve seat; 182*c*: Opening portion; 190: Inflow valve mechanism.

DETAILED DESCRIPTION OF THE PREFERRED EMBODIMENT

Preferred embodiments of the present invention will be described below.

The present invention can be characterized in an embodiment by comprising a cylinder detachably supported by a cylinder-supporting member; a piston member which is detachably connected to a motor drive mechanism via a piston-supporting member and is able to reciprocate inside the cylinder driven by the motor drive mechanism; an outflow valve mechanism attached to the cylinder, which opens an outlet head of the cylinder when the inside of the cylinder is pressurized; an inflow valve mechanism which opens an inflow entrance of the cylinder when the inside of the cylinder is depressurized; the first fluid-storing container which is provided with its opening portion communicated with the inflow entrance. According to the above, because the cylinder detachably supported by the cylinder-supporting member and the motor drive mechanism are detachably connected to each other via the piston-supporting member, it is possible to replace the fluid discharge pump with another fluid discharge pump by removing it from the fluid discharge pumping apparatus. Consequently, it becomes possible to use low-cost disposable fluid discharge pumps.

Another embodiment of the present invention can be characterized in that changing a traveling stroke of the piston by controlling the motor drive mechanism changes a fluid discharge amount. According to the above, because a traveling stroke of the piston can be changed by controlling the motor drive mechanism, a fluid discharge amount can be changed arbitrarily.

Still another embodiment of the present invention can be characterized by comprising a connection mechanism, which detachably connects the opening portion of the first fluid-storing container and the inflow entrance of the cylinder. According to the above, because the connection mechanism, which detachably connects the opening portion of the first fluid-storing container and the inflow entrance of the cylinder, is provided, it becomes possible to replace only the first fluid-storing container.

Yet another embodiment of the present invention can be characterized by further comprising the second fluid-storing container with its opening portion communicated with the outlet head of the cylinder, and a connection mechanism, which detachably connects the opening portion of the second fluid-storing container and the outlet head of the cylinder. According to the above, because the second fluid-storing container with its opening portion communicated with the outlet head of the cylinder is further provided, and the connection mechanism, which detachably connects the opening portion of the second fluid-storing container and the outlet head of the cylinder is provided, it becomes possible to replace the second fluid-storing container with another second fluid-storing container or a different type of the second fluid-storing container by removing it from the fluid discharge pump.

An additional embodiment of the present invention can be characterized in that the outflow valve mechanism and the inflow valve mechanism respectively have a resin valve seat portion having an opening portion, and a resin valve body having a shape corresponding to a shape of the opening portion; the valve body is constructed to be movable between a position in which the opening portion in the valve seat portion is closed and a position in which the opening portion is opened. According to the above, because the outflow valve mechanism and the inflow valve mechanism respectively have a valve seat portion having an opening portion and a valve body having a shape corresponding to a shape of the opening portion, and the valve body has a resin valve portion, which can move between a position in which the opening portion in the valve seat portion is closed and a position in which the opening portion is opened, it becomes possible to use further low-cost disposable fluid discharge pumps.

The present invention can be characterized in various ways other than the above, and elements can be interchangeably used.

The present invention is described by referring to figures. However, the present invention should not be limited to the specific configurations indicated in the figures. In the figures, six preferable embodiments are shown. However, any elements used in each embodiment can be interchangeably used in another embodiment in any suitable combination. For example, an inflow valve mechanism and an outflow valve mechanism can be of the same type or of different types and can be selected from any one of the figures or any other types not indicated in the figures. These embodiments do not intend to limit the present invention.

FIG. 1 is an explanatory diagram of a first embodiment of the fluid discharge pumping apparatus according to the present invention.

This fluid discharge pumping apparatus is used for applying a fluid comprising food to an object 110 to which the fluid is applied, which comprises food.

As shown in FIG. 1, the first embodiment of the fluid discharge pumping apparatus according to the present invention comprises a fluid discharge pump 1, a motor drive mechanism 60, a control portion 70 and the first fluid-storing container 80.

Figure 2:
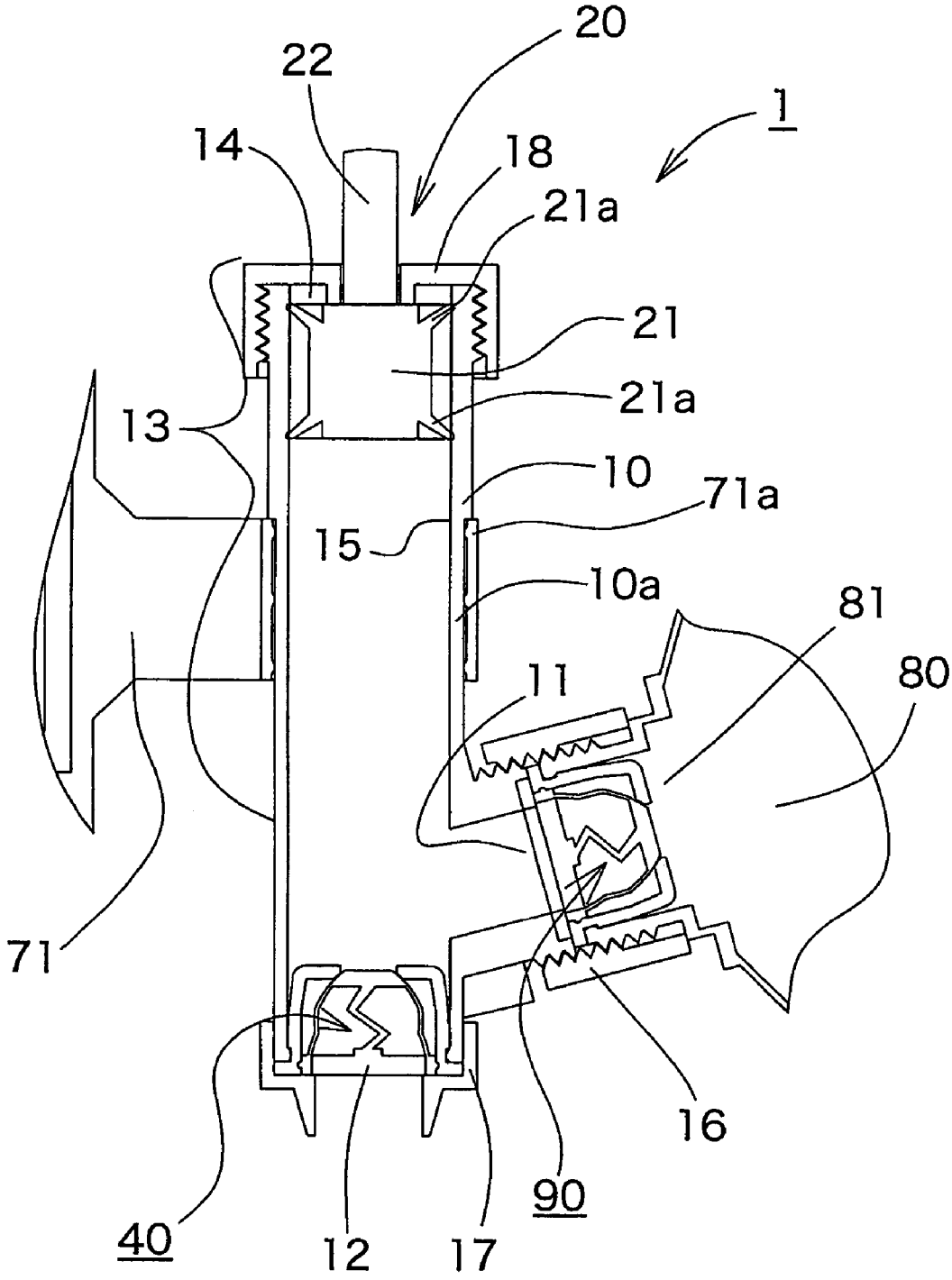
FIG. 2 is a longitudinal sectional view of a discharge pump 1 in a fluid discharge pumping apparatus according to an embodiment of the present invention.

FIG. 2 is a longitudinal sectional view of the fluid discharge pump 1 in the first embodiment of the fluid discharge pumping apparatus according to the present invention.

As shown in FIG. 2, the fluid discharge pump 1 possesses a cylinder 10, a piston member 20 capable of reciprocating inside the cylinder 10 driven by the motor drive mechanism 60, and an outflow valve mechanism 40 set up in an outlet head 12 detachably to the cylinder 10.

The cylinder 10 possesses an inflow entrance 11 for letting a fluid flow in, the outlet head 12 for discharging the fluid, a piston-traveling portion 13 inside which a piston 21 can reciprocate, and a piston member insertion slot 14 for inserting a piston member 20. With a portion to be gripped 10*a* gripped by a gripper 71*a* in the cylinder-supporting member 71, which extends from the control portion 70, the cylinder 10 is detachably supported by the control portion 70. Additionally, because multiple convex portions 71*b* (See FIG. 6.) are formed in the gripper 71*a*, the portion to be gripped 10*a* is gripped without slipping from the gripper 71*a*. The cylinder 10 is produced by injection molding, etc. using a material such as a synthetic resin including polyethylene, rubber including silicon rubber, or a synthetic resin containing a rubber ingredient. Consequently, the cylinder can be easily replaced with another cylinders 10; a fluid can be changed without cleaning the inside of the cylinder 10. Consequently, using disposable cylinders 10 becomes possible.

The piston member 20 possesses a piston 21, which can reciprocate in a piston-traveling portion 13 inside the cylinder 10, and a piston-supporting shaft 22. With an end portion 22*a* in the piston-supporting shaft 22 inserted into a piston-supporting portion 65*c* in the piston-supporting member 65, and a concave portion 22*b* in the piston-supporting shaft 22 engaged with a convex portion 65*d* in the piston-supporting member 65, the piston member 20 is detachably connected to the motor drive mechanism 60 via the piston-supporting portion 65. Additionally, the piston member 20 is inserted into the cylinder 10 from the piston member insertion slot 14. The piston 21 possesses a pair of contact portions 21*a*, which contact an inner circumference 15 of the cylinder 10. The end portion 22*a* of the piston-supporting shaft 22 is connected to the piston-supporting member 65, which reciprocates driven by the motor 61. Consequently, it becomes possible for the piston 21 to reciprocate inside the cylinder 10 liquid-tightly.

The piston member 20 inserted from the piston member insertion slot 14 provided in the cylinder 10 is joined with the cylinder 10 with the piston-supporting shaft 22 passing through a hole formed in a restricting member 18. The hole formed in the restricting member 18 has a diameter larger than an outer diameter of the piston-supporting shaft 22 and smaller than an outer diameter of the piston 21.

Figure 3:
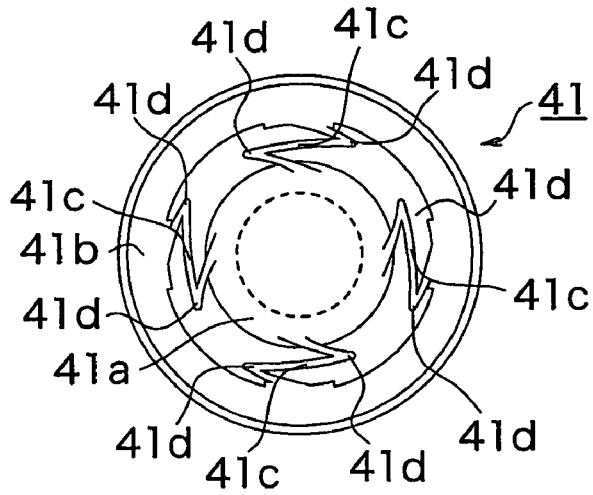
FIG. 3(*a*), a bottom view, and FIG. 3(*b*), a side view and a cross sectional view, show explanatory diagrams of a valve portion 41 and a valve seat portion 42, which form an outflow valve mechanism 40 in an embodiment of a fluid discharge pumping apparatus according to the present invention.
Figure 3:
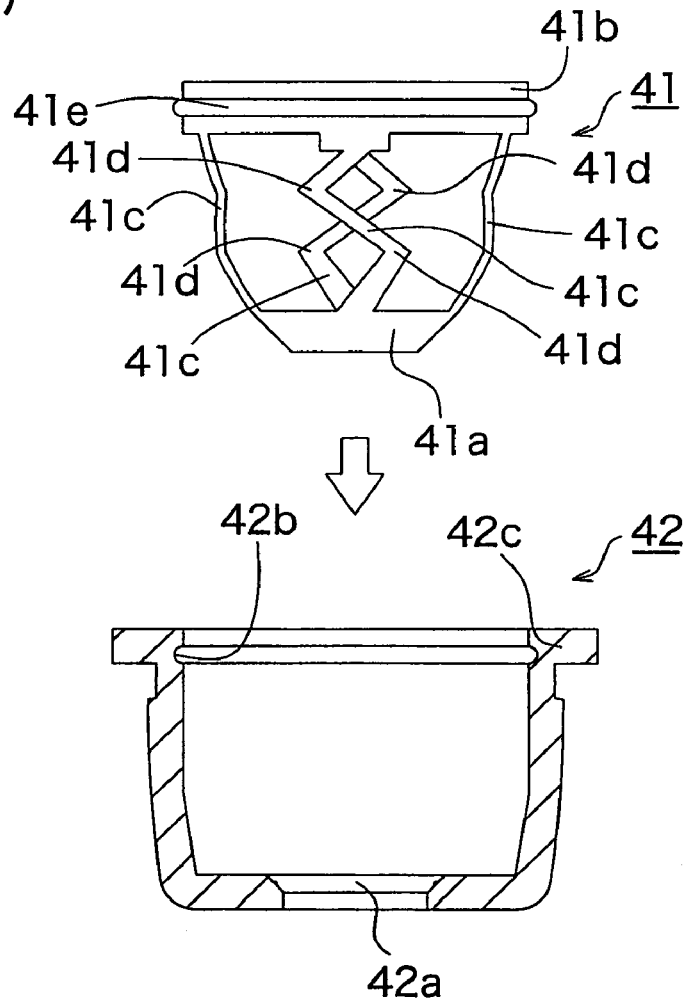
Figure 4:
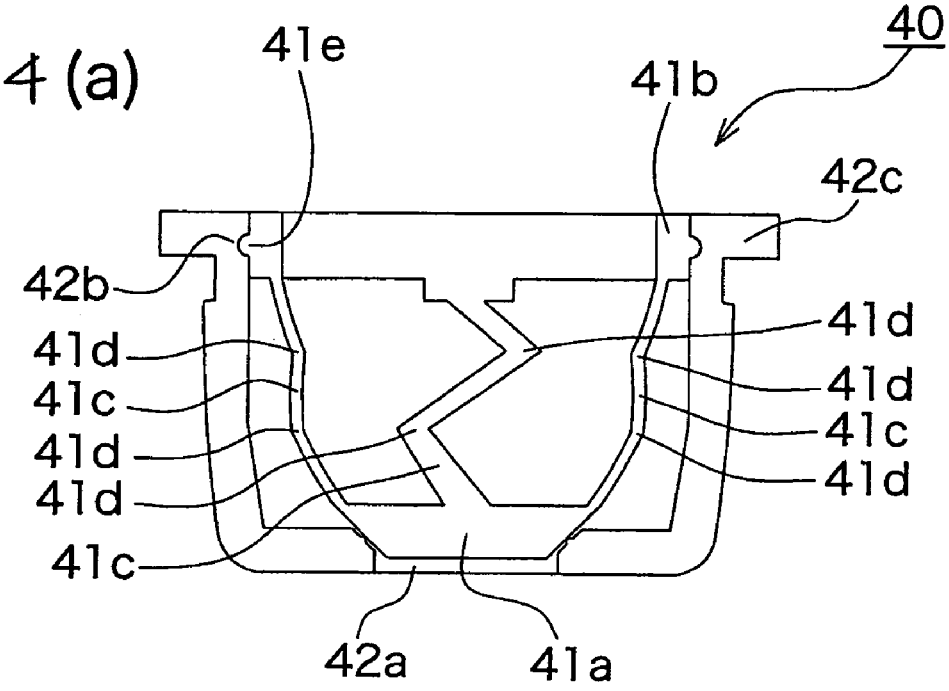
FIG. 4(*a*) and FIG. 4(*b*) show cross-section views of actions of an outflow valve mechanism 40 in an embodiment of the fluid discharge pumping apparatus according to the present invention.
Figure 4:
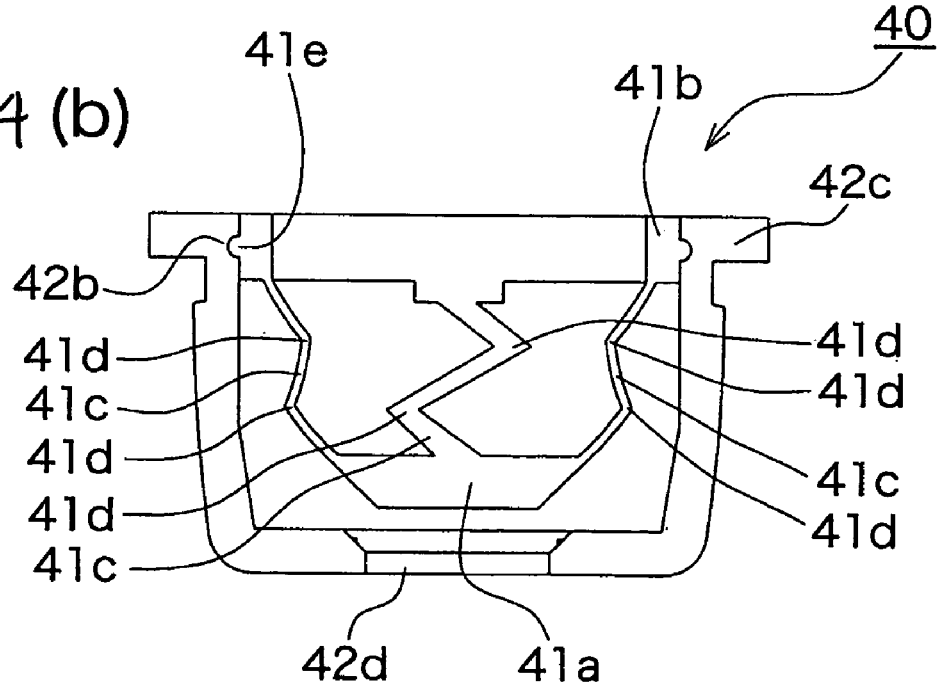

FIG. 3 shows explanatory diagrams of a valve portion 41 and a valve seat portion 42, which form the outflow valve mechanism 40 in the first embodiment of the fluid discharge pumping apparatus according to the present invention. FIG. 4 shows cross-section views of actions of the outflow valve mechanism. FIG. 3(*a*) is a plain view of the valve portion 41; FIG. 3(*b*) illustrates how the valve portion 41 and the valve seat portion 42 are assembled; in FIG. 3(*b*), a lateral view of the valve portion 41 and a cross-section view of the valve seat portion 42 are shown.

As shown in these figures, the outflow valve mechanism 40 has the valve member 41 and the valve seat member 42. The valve seat portion 42 has a nearly cylindrical shape with a circular opening portion 42*a* functioning as a valve seat formed at its bottom. Upward on the inner wall of the valve seat portion 42, a concave portion 42*b* is formed.

The valve portion 41 has a ring-shaped supporting portion 41*b* set up inside the valve seat portion 42, a valve body 41*a* having a shape corresponding to the circular opening portion 42*a* in the valve seat portion 42, and four connecting portions 41*c* coupling the supporting portion 41*b* and the valve body 41*a*. The four connecting portions 41*c* respectively have a pair of elbow-shaped bends 41*d*. In this valve portion 41, the valve body 41*a* is constructed to be movable between a position in which the opening portion 42*a* in the valve seat portion 42 is closed and a position in which the opening portion 42*a* is opened by flexibility of these four connecting portions 41*c*. When pressure is applied from the lower side of a page showing FIGS. 4(*a*) and 4(*b*), the valve body 41*a* moves to the above-mentioned opened position as shown in FIG. 4(*b*).

On a peripheral surface of the supporting portion 41*b* in the valve portion 41, a convex portion 41*e* is formed.

Consequently, when the valve portion 41 is inserted into the valve seat portion 42, the concave portion 42*b* in the valve seat portion 42 and the convex portion 41*e* in the valve portion 41 are engaged with each other to lock the valve portion 41 in place inside the valve seat portion 42.

Additionally, the valve seat portion 42 further possesses a fixing portion 42*c*. Consequently, the fixing portion 42*c* is held tightly by the cylinder 10 and a fixing member 17 to lock the outflow valve mechanism 40 in place inside the cylinder 10. The outflow valve mechanism 40 is set up with the lower side on the FIG. 4 page facing the inside of the cylinder 10 so that the valve body 41*a* moves to the opened position when the inside of the cylinder 10 is pressurized.

The valve portion 41 and the valve seat portion 42 are produced by injection molding, etc. using a material such as a synthetic resin including polyethylene, rubber including silicon rubber, or a synthetic resin containing a rubber ingredient.

Figure 5:
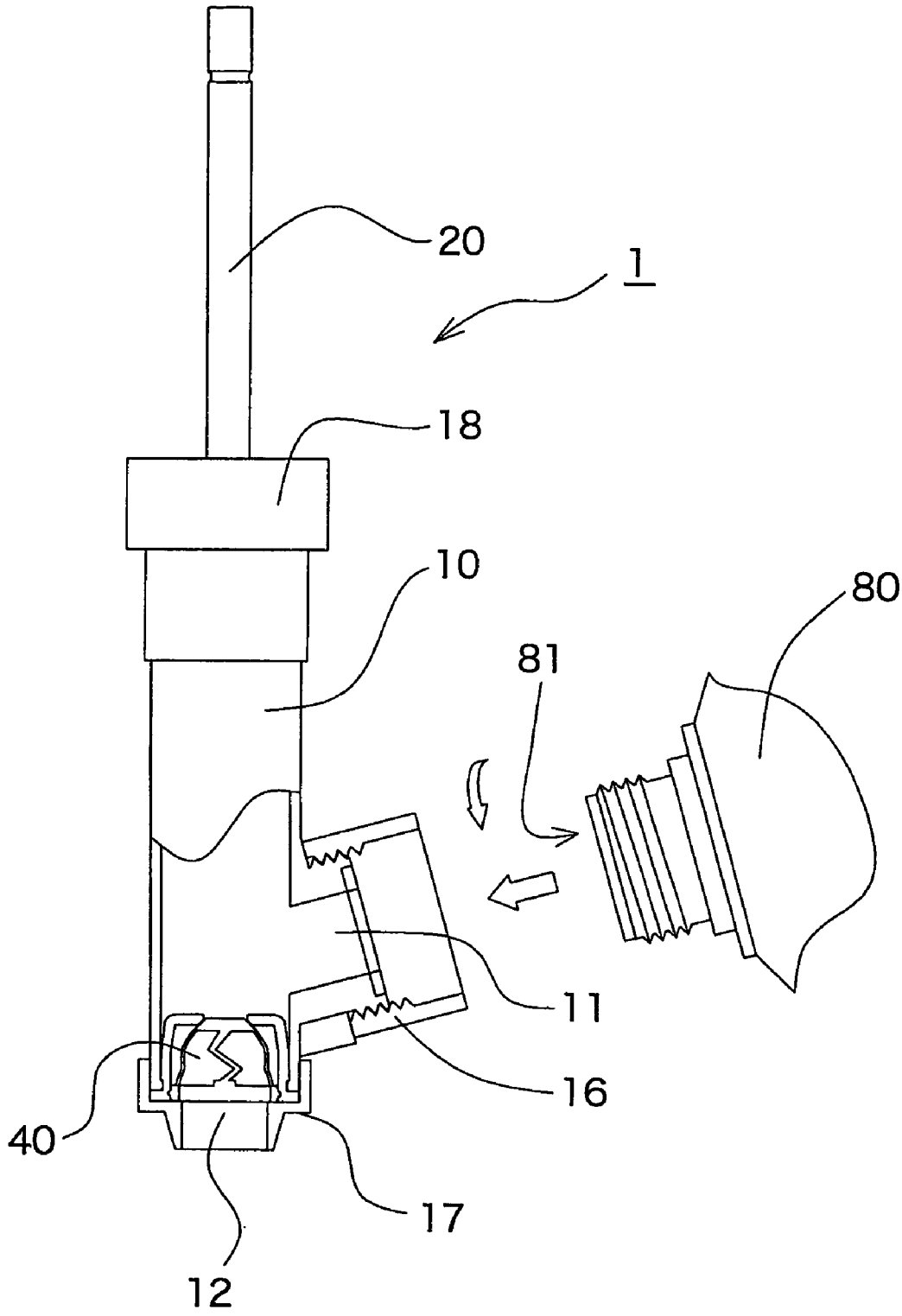
FIG. 5 is an explanatory diagram of a junction portion of a discharge pump 1 and a fluid-storing container 80 in an embodiment of the fluid discharge pumping apparatus according to the present invention.

FIG. 5 is an explanatory diagram of a junction portion of the fluid discharge pump 1 and the fluid-storing container 80 in the first embodiment of the fluid discharge pumping apparatus according to the present invention.

The first fluid-storing container 80 possesses an opening portion 81 and a fluid-storing portion 82. As shown in FIG. 5, the first fluid-storing container 80 is set up with its opening portion 81 communicated with an inflow entrance 11 of the cylinder 10. Both periphery of the inflow entrance 11 in the cylinder 10 and periphery of the opening portion 81 in the first fluid-storing container 80 have an identical male-screw shape; the cylinder 10 and the first fluid-storing container 80 are joined by a nut 16 having a shape corresponding to the male-screw shape. Consequently, the cylinder 10 and the first fluid-storing container 80 are detachably connected, hence can be separated.

Additionally, the first fluid-storing container 80 possesses an inflow valve mechanism 90, which is detachably attached to the fluid-storing container 80, inside the opening portion 81. This inflow valve mechanism 90 has an identical construction to the construction of the outflow valve mechanism 40 shown in FIG. 3 and FIG. 4. When the inside of the cylinder 10 is depressurized, the inflow valve mechanism 90 is inserted/fitted into an opening portion 51 in the first fluid-storing container 80 in a direction in which the upper side of the FIG. 4 page facing the inside of the cylinder 10 so as to open the inflow entrance 11 of the cylinder 10.

Figure 6A:
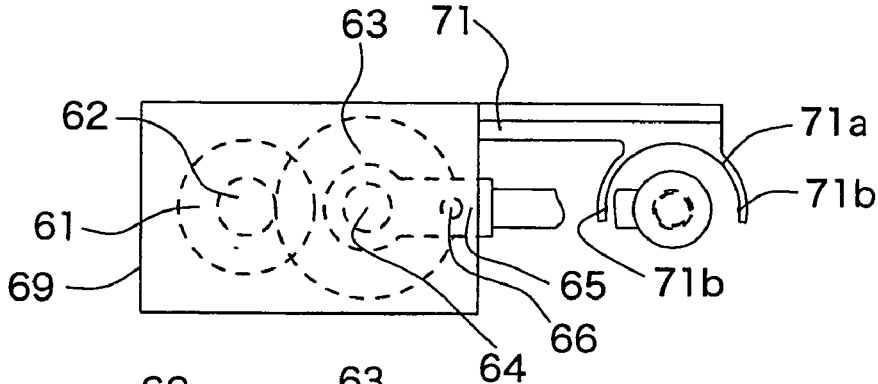
FIG. 6(*a*) and FIG. 6(*b*) show explanatory diagrams of a motor drive mechanism 60 and a control portion 70 in an embodiment of the fluid discharge pumping apparatus according to the present invention.
Figure 6B:
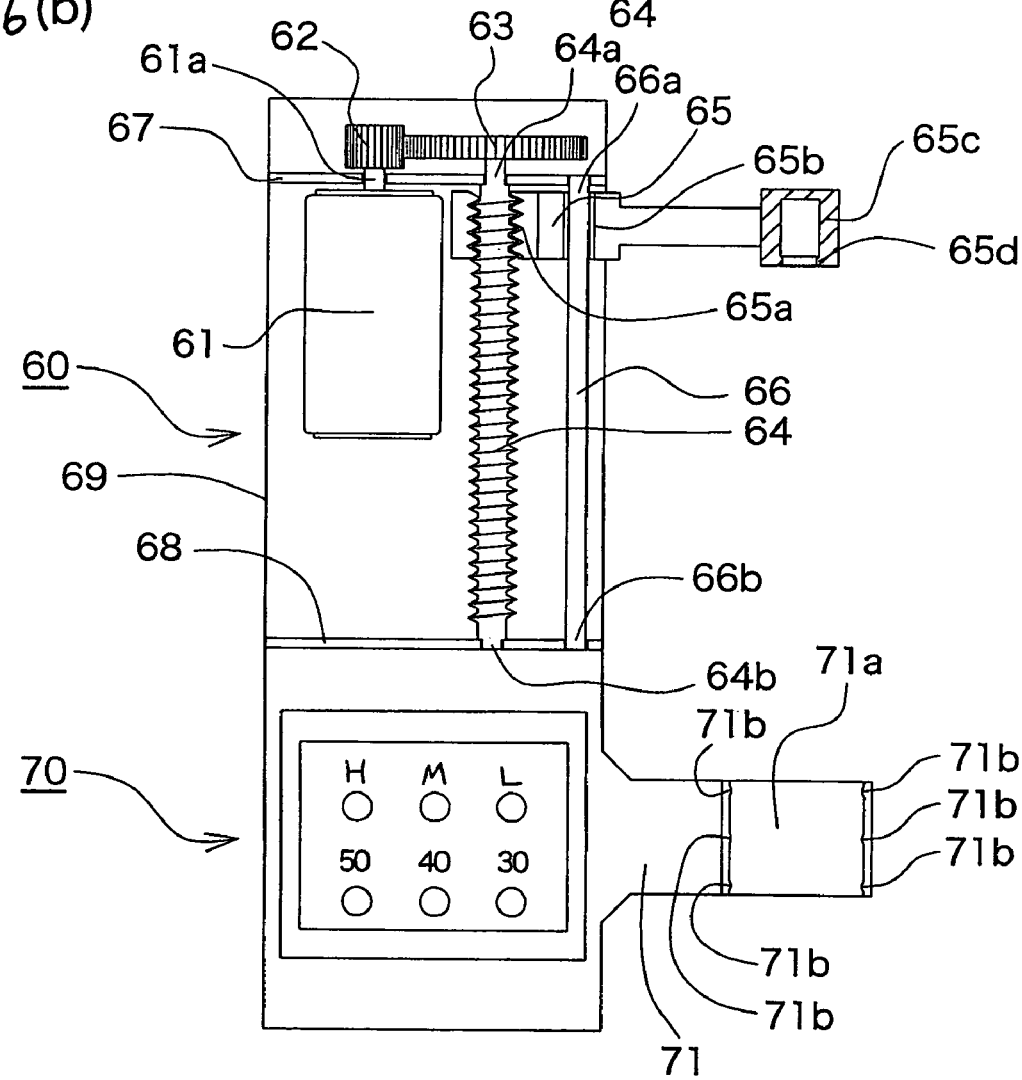

FIG. 6(*a*) is a plain view of the motor drive mechanism 60 and the control portion 70 in the first embodiment of the fluid discharge pumping apparatus according to the present invention. FIG. 6(*b*) is a front view of the motor drive mechanism 60 and the control portion 70 in the first embodiment of the fluid discharge pumping apparatus according to the present invention.

The motor drive mechanism 60 possesses a chassis 69, a motor 61, the first gear 62 connected to a rotating shaft 61*a* of the motor 61, the second gear 63 engaging with the first gear 62, a ball screw 64 joined with the shaft center of the second gear 63, a piston-supporting member 65 which moves along the shaft center of the second gear 62 as the ball screw 64 rotates, a guide member 66 provided parallel to a long-edge direction of the ball screw, an upper shroud 67 fixed in the chassis 69 in a position that an upper-end portion 64*a* of the ball screw 64 and an upper-end portion 66*a* of the guide member 66 are rotatably supported by the shaft, and a lower shroud 68 fixed in the chassis 69 in a position that a lower end portion 64*b* of the ball screw 64 and a lower-end portion 66*b* of the guide member 66 are rotatably supported by the shaft. The motor drive mechanism 60 is set up on top of the control portion 70.

As shown in FIG. 6, the motor 61 is fixed in the chassis 69 with its rotating shaft 61*a* passing through the third hole portion c in the upper shroud 67. Additionally, a revolving speed and revolving time, etc. of the motor 61 can be changed by connecting it to the control portion 70.

The rotating shaft 61*a* in the motor 61 is joined with the shaft center of the first gear 62. Additionally, the first gear 62 and the second gear 63 are engaged with each other; these gears are interlocked and rotate. The second gear 63 and the ball screw 64 are joined with the shaft center of the second gear 63 with the ball screw 64 perpendicular to a rotary surface of the second gear 63. Consequently, the ball screw 64 rotates by rotation of the second gear 63.

The piston-supporting member 65 possesses a male-screw portion 65*a* which can be screwed together with the ball screw 64, a guide hole 65*b* which the guide member 66 is let through, and a piston-supporting portion 65*c* supporting the piston member 20. This construction allows the piston-supporting member 65 to move along the guide member 66 as the ball screw rotates.

Figure 7:
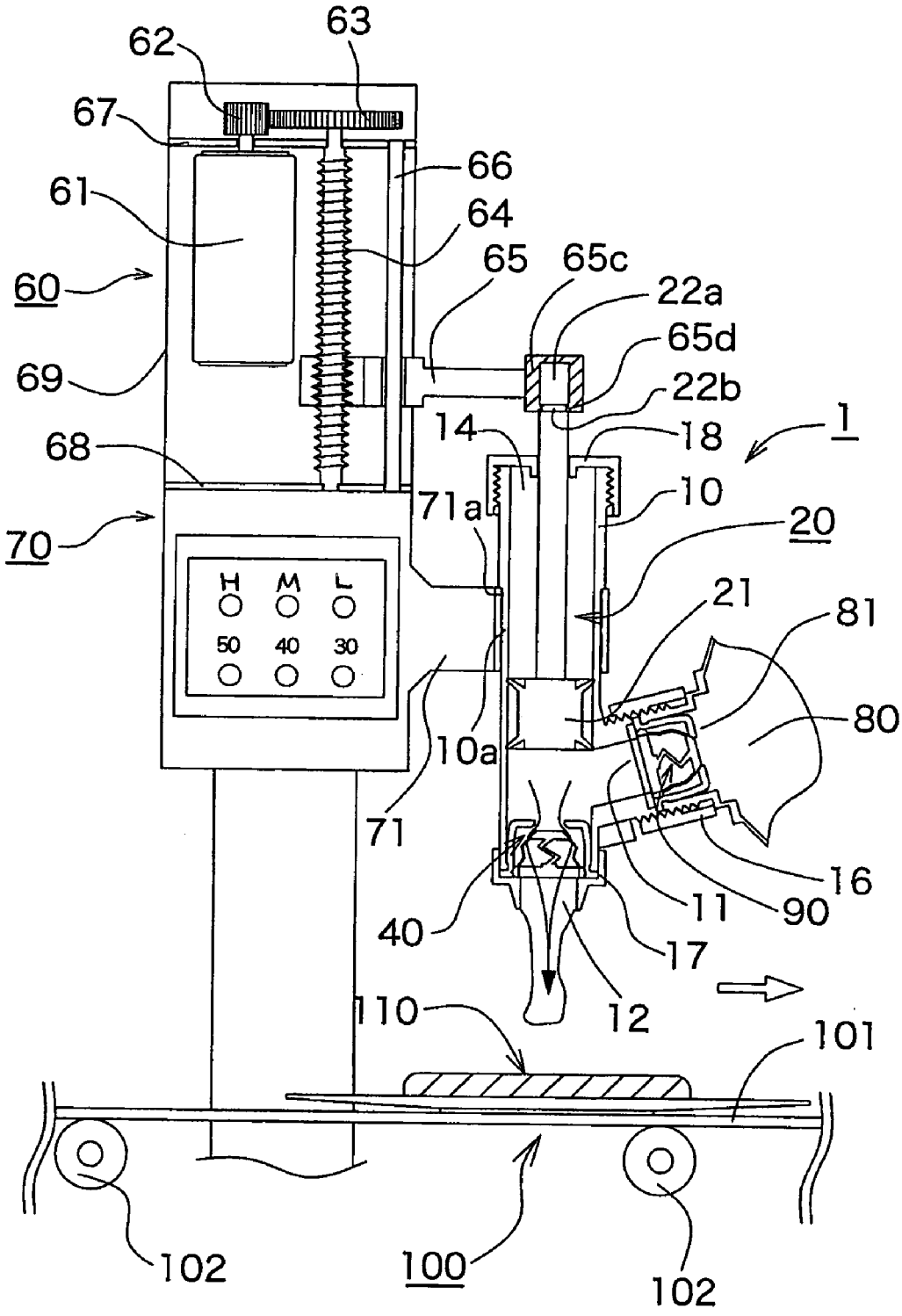
FIG. 7 is an explanatory diagram of reciprocating motion of a piston 20 inside a cylinder 10 in an embodiment of the fluid discharge pumping apparatus according to the present invention.
Figure 8:
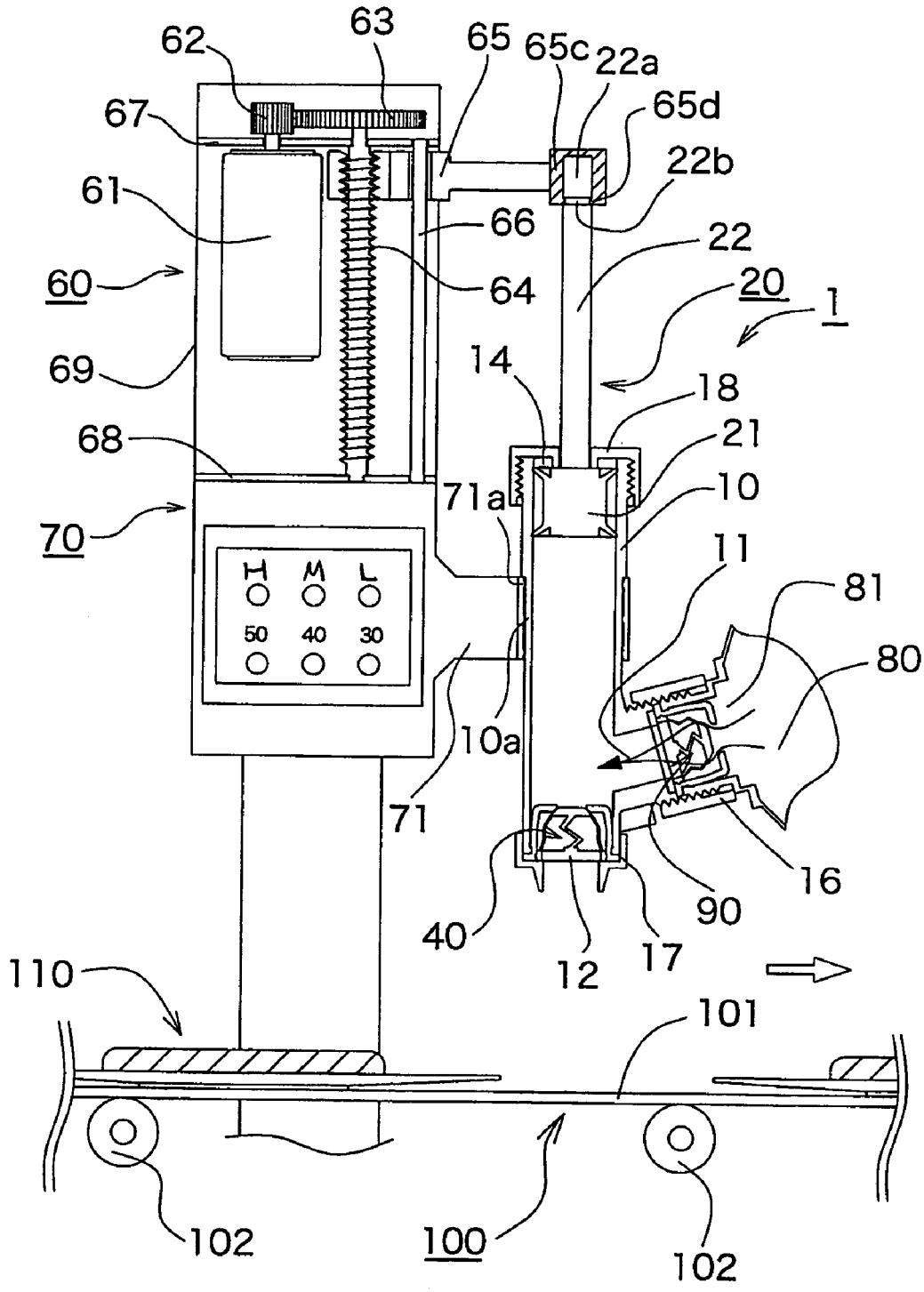
FIG. 8 is an explanatory diagram of reciprocating motion of a piston 20 inside a cylinder 10 in an embodiment of the fluid discharge pumping apparatus according to the present invention.

FIG. 7 and FIG. 8 are explanatory diagrams of reciprocating motion of the piston 20 inside the cylinder 10 in the first embodiment of the fluid discharge pumping apparatus according to the present invention.

FIG. 7 shows the fluid discharge pumping apparatus with a belt conveyor system 110 set up directly under the outlet head 12. The belt conveyor system 100 possesses a belt 101 and multiple rollers 102 supporting the belt 101. The belt 101 has an endless shape and moves driven by a drive mechanism not shown. Multiple rollers 102 move in synchronization with movement of the belt 101. An object to which a fluid is applied is placed on the belt 101 and moves as the belt 101 moves. By this movement, when the object 110 is positioned directly under the outlet head 12 in the fluid discharge pump 1, the piston 21 in the fluid discharge pump 1 moves in a direction of the lower side of the FIG. 7 page by rotation of the motor 61 and pressurizes the inside of the cylinder 10. This pressurization opens the outflow valve mechanism 40, and the fluid stored inside the cylinder 10 is discharged from the outlet head 12. The discharged fluid is applied onto the object 110 positioned directly under the outlet head 12.

When this application work is finished, as shown in FIG. 8, the piston 21 in the fluid discharge pump 1 moves to the upper side of the FIG. 8 page by rotation of the motor 61 and depressurizes the inside of the cylinder 10. This depressurization closes the outflow valve mechanism 40 as well as opens the inflow valve mechanism 90, and the fluid stored inside the first fluid-storing container 80 flows into the cylinder 10. Subsequently, after waiting for the next object 110 to which the fluid is applied to move directly under the outlet head 12 in the fluid discharge pump 1, the above-mentioned actions are repeated.

By controlling a rotational amount of the motor here, a traveling stroke of the piston 21 can be changed. By doing this, it becomes possible to change a fluid amount to be discharged from the outlet head 12 in the fluid discharge pump 1. More specifically, a worker can change a scheduled discharge amount by selecting any one of, e.g. 30 cc, 40 cc or 50 cc; based on a selection made by the worker, a traveling stroke of the piston 21 is controlled to accommodate the scheduled discharge amount selected. Additionally, a traveling stroke can be controlled based on an arbitrary scheduled discharge amount inputted by the worker as well.

Furthermore, accommodating a moving speed of an object 110 to which the fluid is applied, a rotational speed of the motor 61 can be changed as well.

Additionally, because the cylinder 10 in the fluid discharge pump 1 is detachably supported by the cylinder-supporting member 71, and the piston member 20 is detachably connected to the piston-supporting member 65, the fluid discharge pump 1 can be removed from the fluid discharge pumping apparatus and replaced with another fluid discharge pump 1. Consequently, food, etc. can be applied in a hygienic condition.

Figure 9:
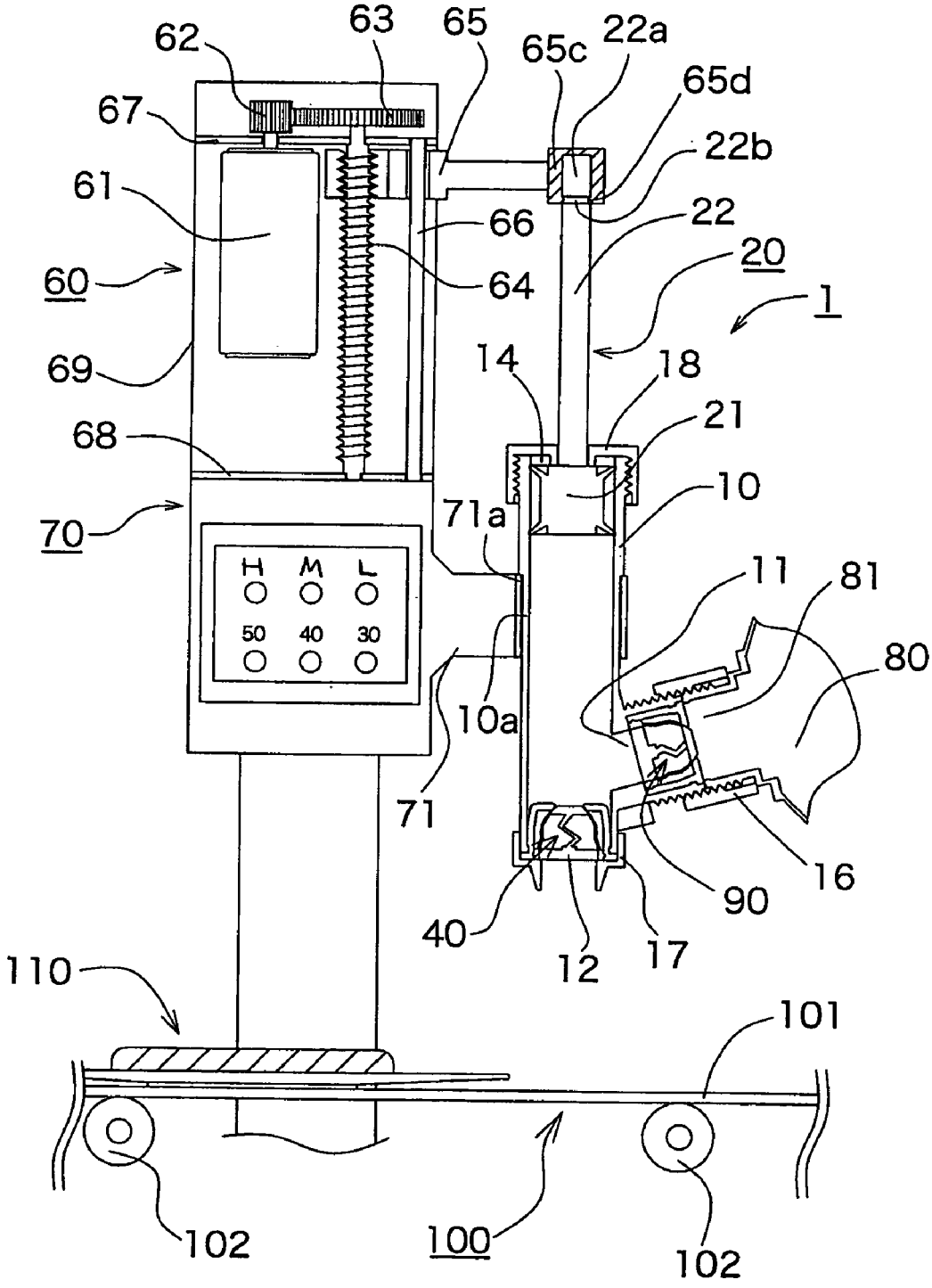
FIG. 9 is an explanatory diagram of an embodiment of the fluid discharge pumping apparatus according to the present invention.
Figure 10:
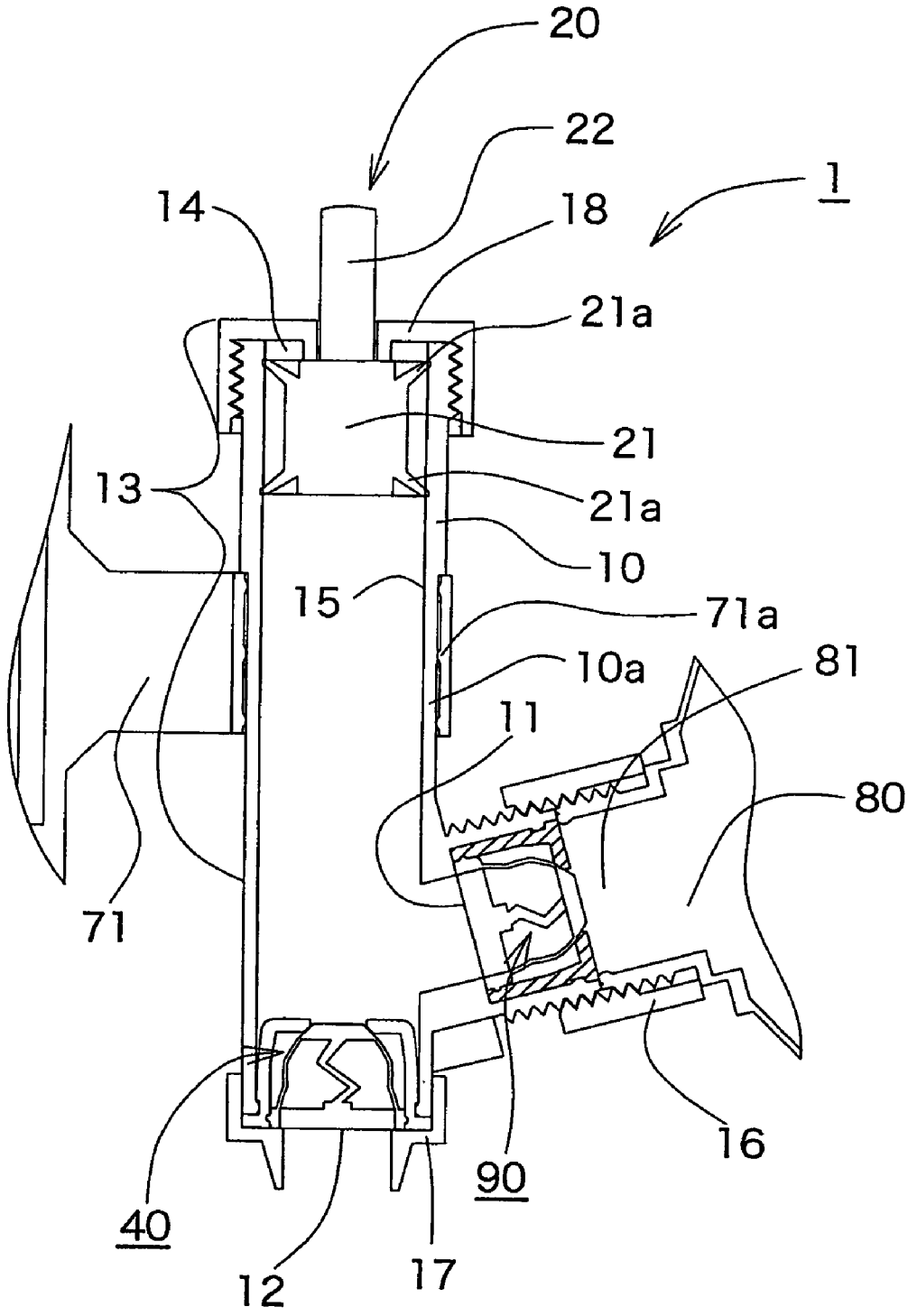
FIG. 10 is a longitudinal sectional view of a fluid discharge pump 1 in an embodiment of the fluid discharge pumping apparatus according to the present invention.

Another embodiment of the fluid discharge pumping apparatus according to the present invention is described by referring to figures. FIG. 9 is an explanatory diagram of a second embodiment of the fluid discharge pumping apparatus according to the present invention. FIG. 10 is a longitudinal sectional view of the fluid discharge pump 1 in the second embodiment of the fluid discharge pumping apparatus according to the present invention.

In the above-mentioned first embodiment of the fluid discharge pumping apparatus according to the present invention, the inflow valve mechanism 90 is provided in the opening portion 81 in the fluid-storing container 80. The second embodiment of the fluid discharge pumping apparatus, however, is constructed that the inflow valve mechanism 90 detachably attached to the cylinder 10 is provided inside the inflow entrance 11 in the cylinder 10. When the first fluid-storing container 80 is replaced, replacing it together with the inflow valve mechanism 90 is not required. Producing a fluid discharge pumping apparatus with further improved economical efficiency, hence, becomes possible.

Figure 11:
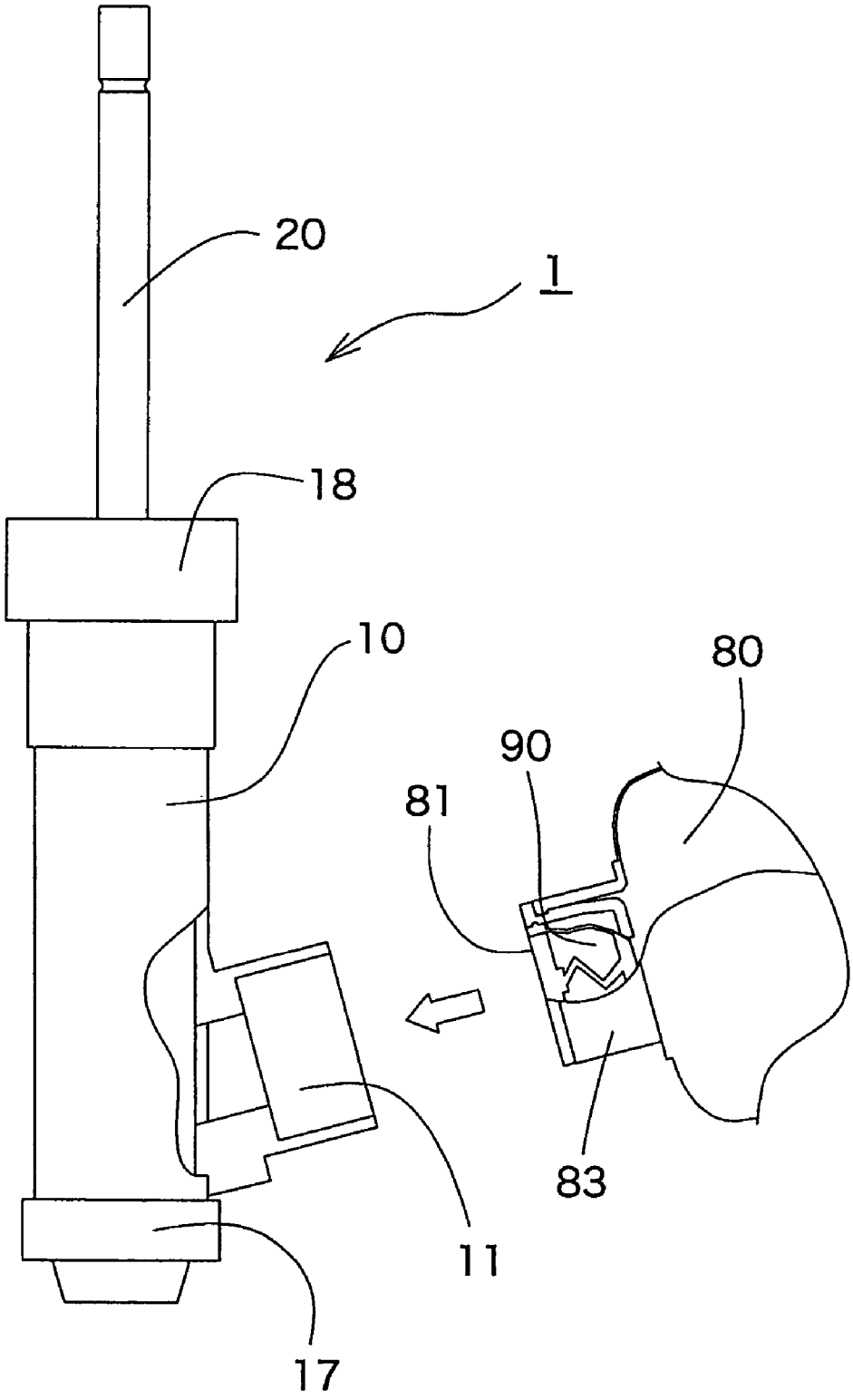
FIG. 11 is an explanatory diagram of a fluid discharge pump 1 in an embodiment of the fluid discharge pumping apparatus according to the present invention.

FIG. 11 is an explanatory diagram of a fluid discharge pump 1 in a third embodiment of the fluid discharge pumping apparatus according to the present invention.

In the above-mentioned first embodiment of the fluid discharge pumping apparatus according to the present invention, both periphery of the inflow entrance 11 in the cylinder 10 and periphery of the opening portion 81 in the first fluid-storing container 80 have an identical male-screw shape; the cylinder 10 and the first fluid-storing container 80 are joined by the nut 16 having a shape corresponding to the male-screw shape. In the third embodiment of the fluid discharge pumping apparatus, however, an insertion portion 83 is formed in a peripheral portion of the opening portion 81 in the first fluid-storing container 80; with this insertion portion 83 inserted into and welded into the inflow entrance 11 in the cylinder 10, the cylinder 10 and the first fluid-storing container 80 are joined. Consequently, the nut 16 is not required, and producing a fluid discharge pumping apparatus with further improved economical efficiency becomes possible.

Figure 12:
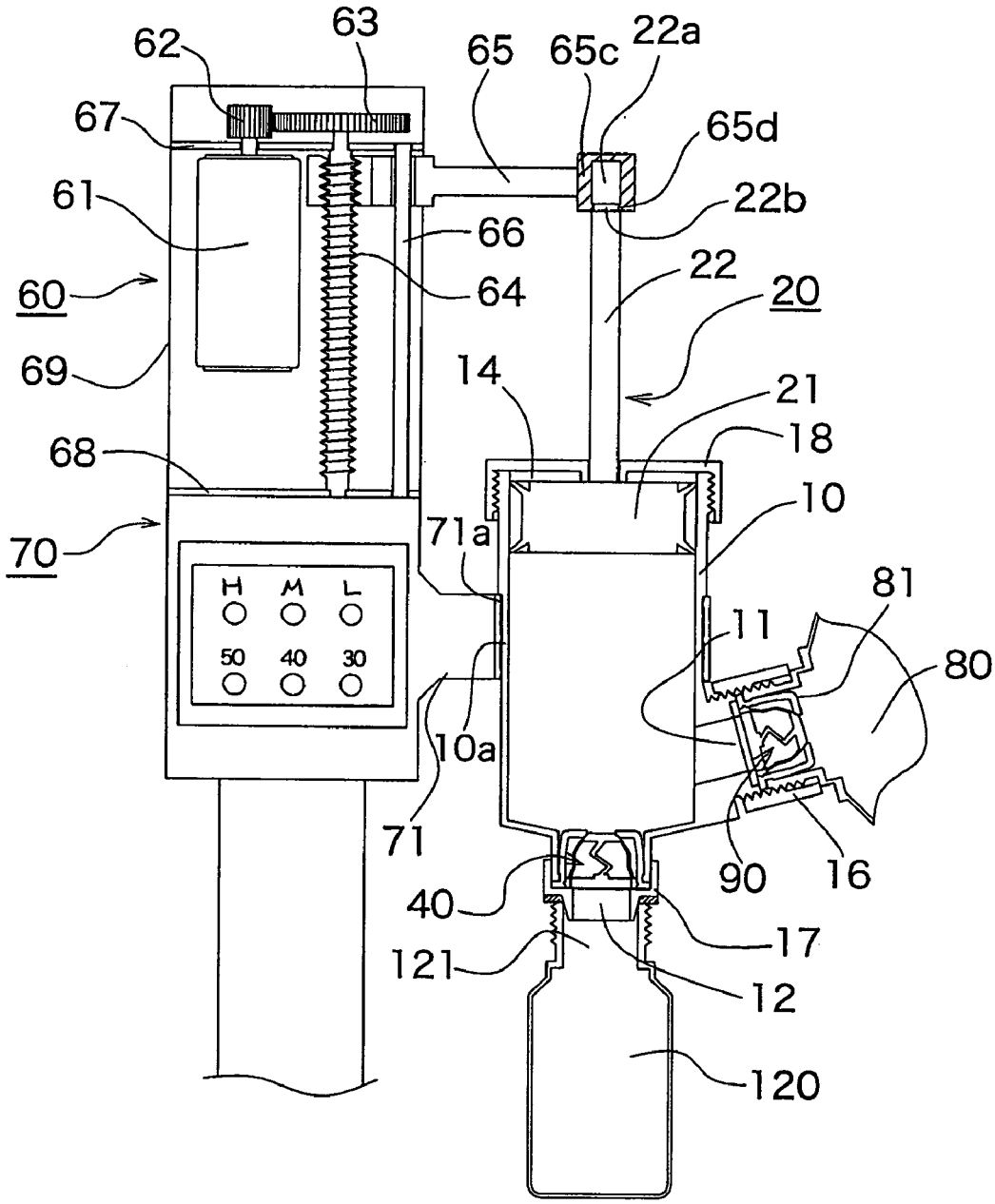
FIG. 12 is an explanatory diagram of an embodiment of the fluid discharge pumping apparatus according to the present invention.

FIG. 12 is an explanatory diagram of a fourth embodiment of the fluid discharge pumping apparatus according to the present invention.

In the above-mentioned first embodiment of the fluid discharge pumping apparatus according to the present invention, a fluid is applied to an object 110, which moves on the belt conveyor 100. The fourth embodiment of the fluid discharge pumping apparatus, however, is constructed to let the fluid flow into the second fluid-storing container 120. This fluid discharge pumping apparatus further possesses the second fluid-storing container 120 having an opening portion 121 communicated with the outlet head 12 in the cylinder 10; the opening portion 121 of the second fluid-storing container 120 and the outlet head 12 of the cylinder 10 are constructed to be detachably connected. Consequently, it becomes possible to remove the second fluid-storing container 120 from the fluid discharge pump 1 to replace it with a different type of the second fluid-storing container 120. In this case, by changing a traveling stroke of the piston member 20, a container having a different size can be selected as the second fluid-storing container 120. Additionally, when the second fluid-storing container 120 is replaced, it is not required to replace it together with the inflow valve mechanism 90. Thus, producing a fluid discharge pumping apparatus with further improved economical efficiency becomes possible.

Having the above-mentioned configuration, the fourth embodiment of the fluid discharge pumping apparatus can be used with gels such as hair gels and cleansing gels or creams such as nourishing creams and cold creams used in the cosmetic field as a fluid. Additionally, this tube-type container can be used as a container for medicines or solvents, water, juices or foods including jellies.

In any one of the above-mentioned embodiments of the fluid discharge pumping apparatus, the valve mechanism, e.g. the one shown in FIG. 3 and FIG. 4 is used as the outflow valve mechanism 40 and the inflow valve mechanism 90. A valve mechanism shown in FIG. 13 to FIG. 15 can also be used.

Figure 13A:
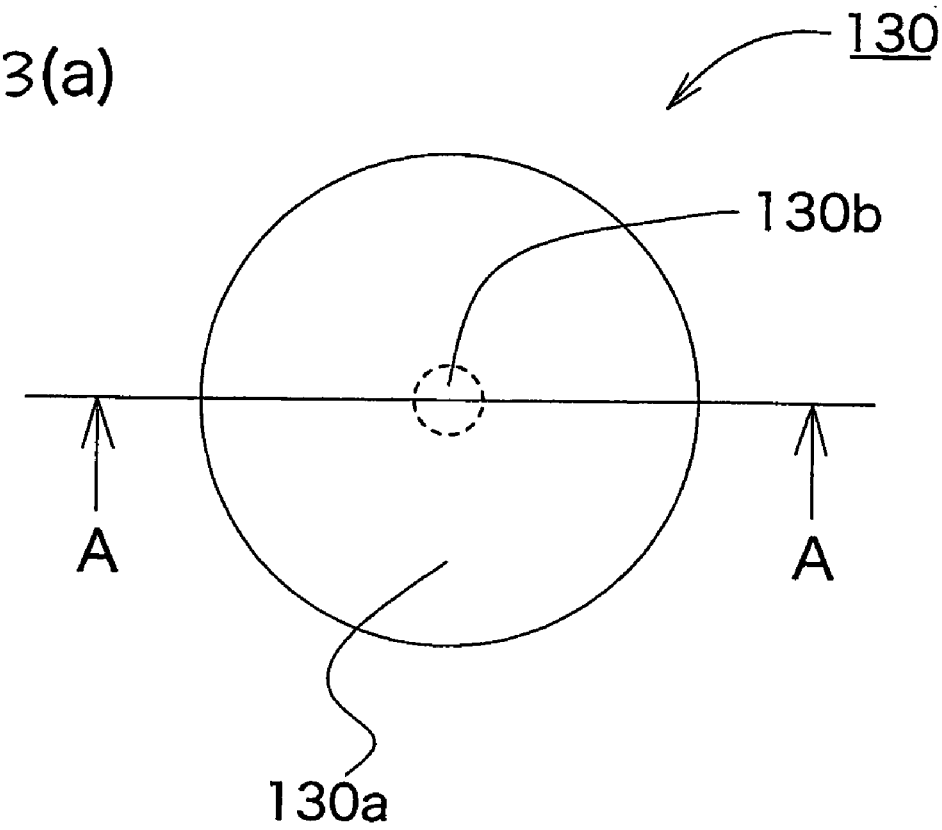
FIG. 13(*a*), a bottom view, and FIG. 13(*b*), a cross sectional view, show explanatory diagrams of a valve member 130 comprising a valve mechanism 150.
Figure 13B:
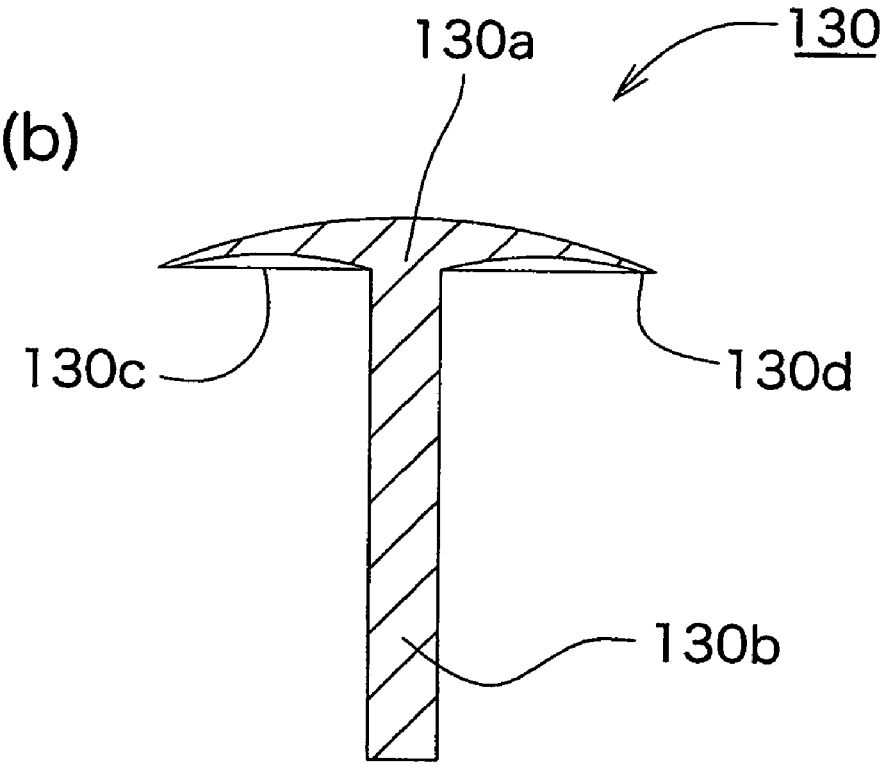
Figure 14A:
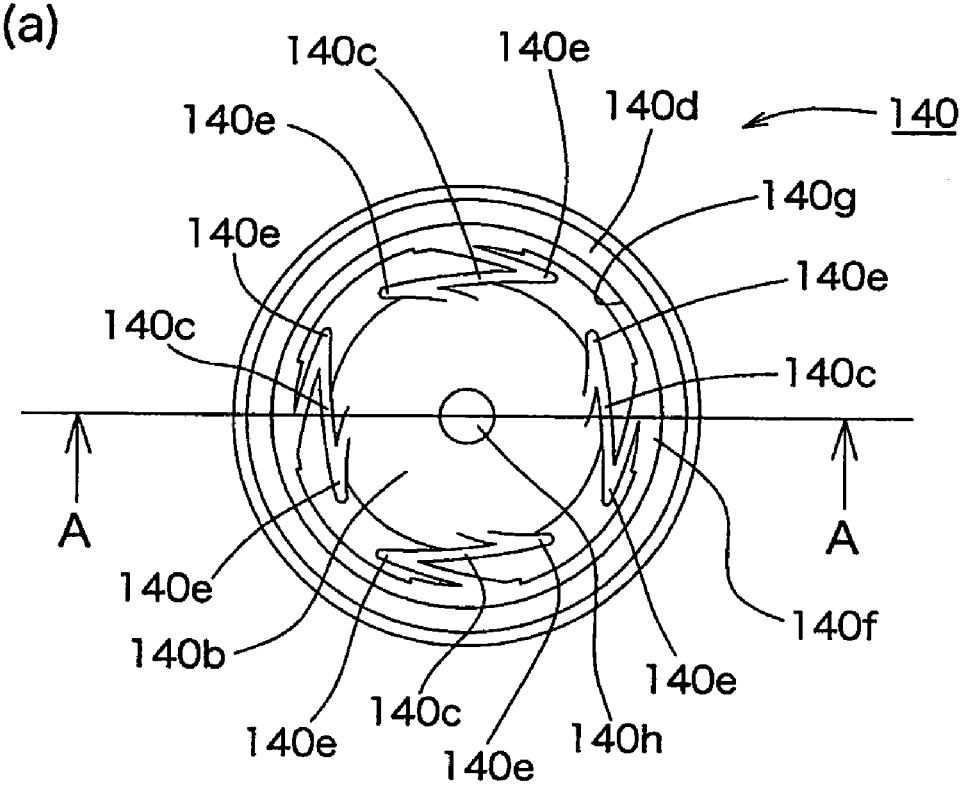
FIG. 14(*a*), a bottom view, and FIG. 14(*b*), a cross sectional view, show explanatory diagrams of a valve seat member 140 comprising a valve mechanism 150.
Figure 14B:
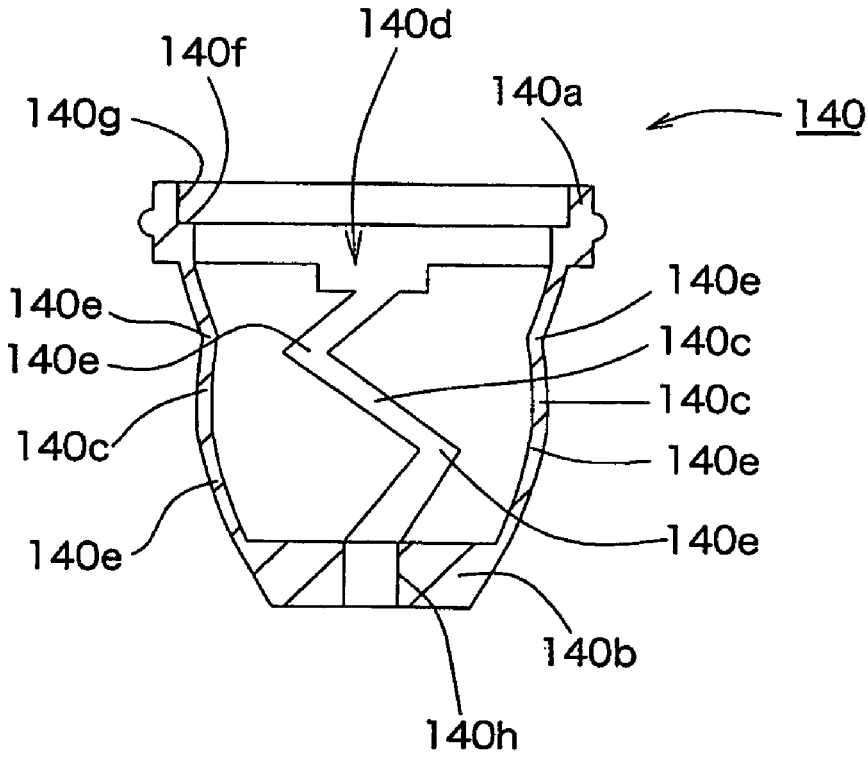
Figure 15A:
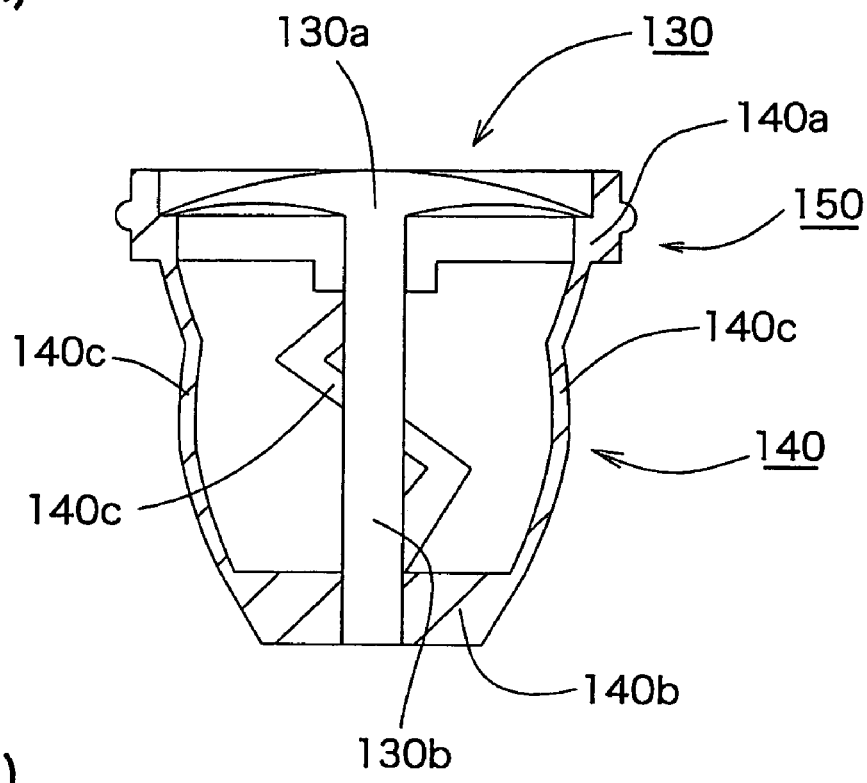
FIG. 15(*a*) and FIG. 15(*b*) show cross-sectional views of actions of a valve mechanism 150.
Figure 15B:
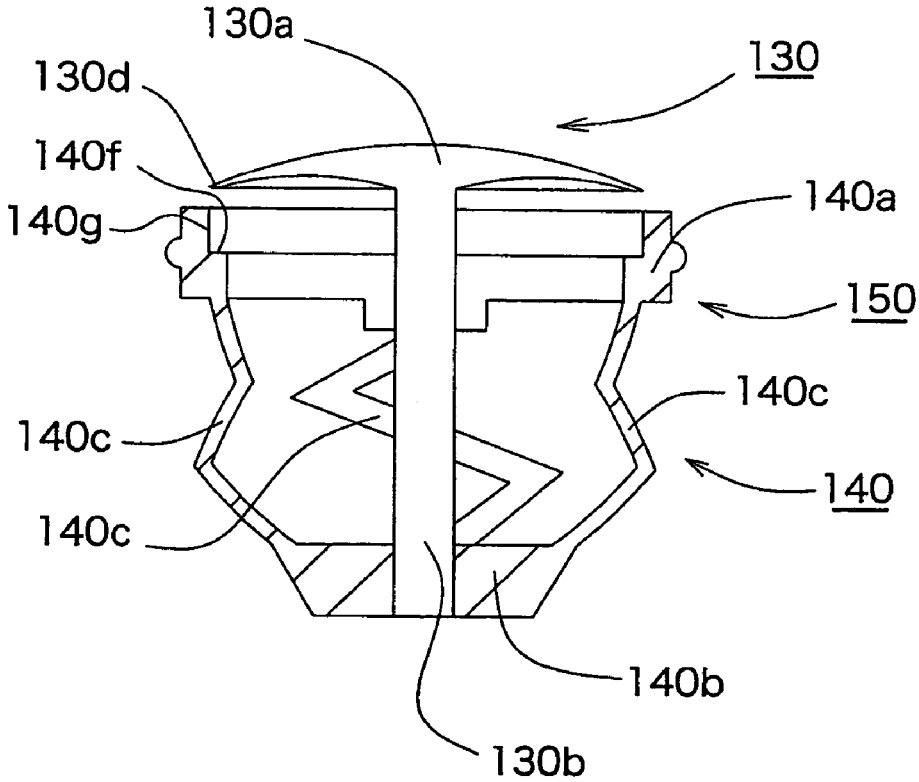

FIG. 13(*a*) is a plain view of a valve member 130 comprising a valve mechanism 150; FIG. 13(*b*) is a lateral view of the valve member 130 comprising the valve mechanism 150; FIG. 14(*a*) is a plain view of a valve seat member 140 comprising the valve mechanism 150; FIG. 14(*b*) is a lateral view of the valve seat member 140 comprising the valve mechanism 150; FIG. 15 shows cross-sectional views of actions of the valve mechanism 150.

As shown in FIG. 13, the valve member 130 possesses a valve body 130*a* and a nearly column-shaped joining portion 130*b* set up standing in the valve body 130*a*.

As shown in FIG. 14, the valve seat member 140 possesses a valve seat portion 140*a* having a circular opening portion 140*d* functioning as a valve seat for the valve body 130*a* in the valve member 130, a valve member supporting portion 140*b* joined with the joining portion 130*b* in the valve member 130, and four connecting portions 140*c* coupling the valve seat portion 140*a* and the valve member supporting portion 140*b*. The four connecting portions 140*c* are made of a flexible resin respectively having a pair of elbow-shaped bends. By flexibility of these connecting portions 140*c*, the valve body 130*a* in the valve member 130 can move between a position in which the opening portion 140*d* in the valve seat member 140 is closed and a position in which the opening portion 140*d* is opened.

Further, in the valve member supporting portion 140*b* in the valve seat member 140, a groove portion 140*h* is formed. By inserting/fitting the joining portion 130*b* in the valve member 130 into this groove portion 140*h*, the valve member 130 and the valve seat member 140 are joined with each other. Additionally, the valve seat portion 140*a* has a horizontal surface 140*f* and a vertical surface 140*g* in its opening portion 140*d*. When the valve member 130 is positioned in the closed position in which the opening portion 140*d* in the valve member 130 is closed, the underside 130*c* of the valve body 130*a* is to contact the horizontal surface 140*f* of the valve seat portion 140*a*, and the end face 130*d* of the valve body 130*a* is to contact the vertical surface 140*g* of the valve seat portion 140*a*.

In this valve mechanism 150, as shown in FIG. 15, pressurized from the lower side of the FIG. 15 page, the valve body 130*a* moves to the upper side of the page along with the valve body supporting portion 140*b*, causing the end face 130*d* of the valve body 130*a* to separate from the vertical surface 140*g* of the valve seat portion 140*a* and forming a flow path for the fluid.

Figure 16:
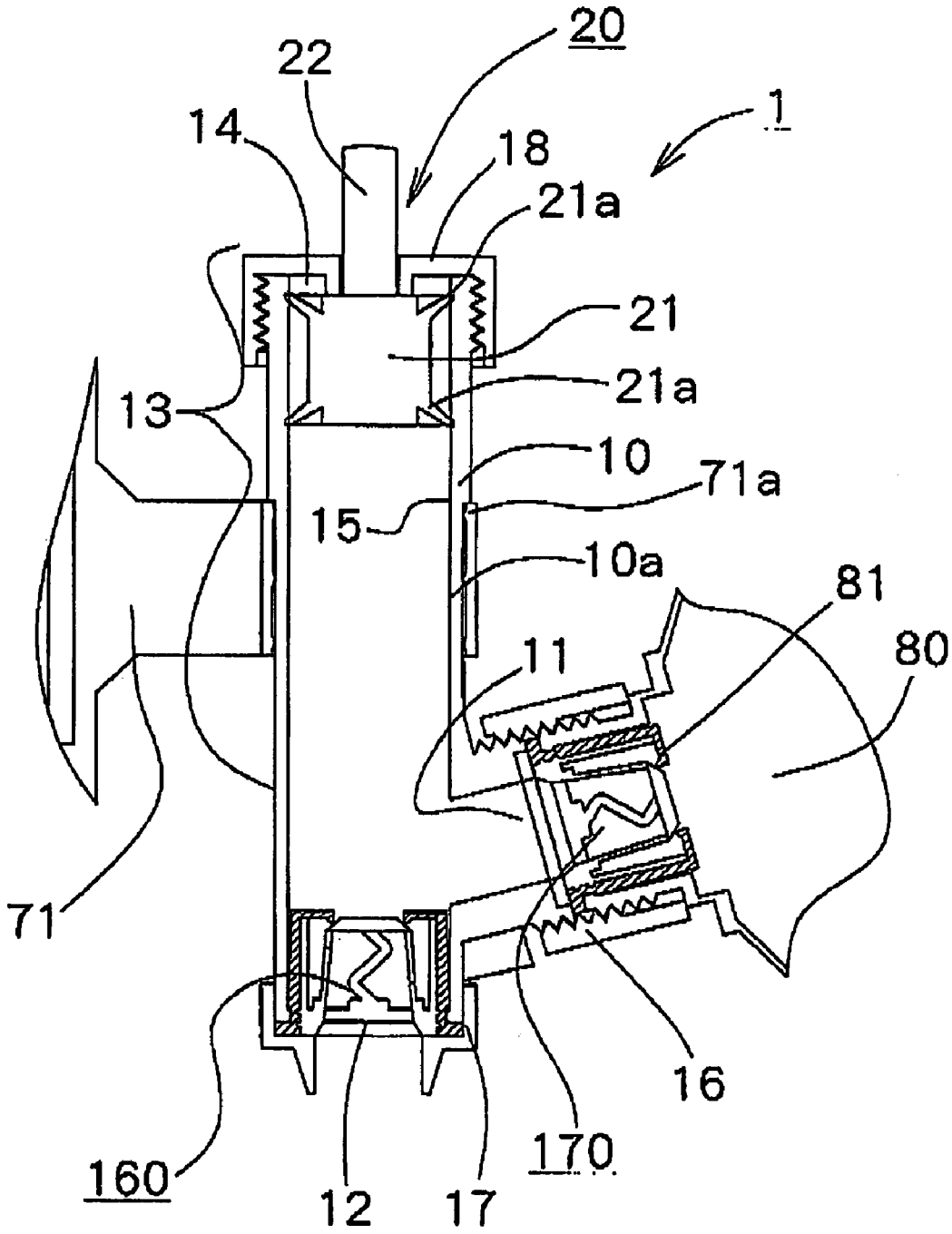
FIG. 16 is a longitudinal sectional view of a discharge pump 1 in a fluid discharge pumping apparatus according to an embodiment of the present invention.

FIG. 16 is a longitudinal sectional view of a discharge pump 1 in a fluid discharge pumping apparatus according to a fifth embodiment of the present invention.

In the first embodiment of the present invention, the fluid discharge pump 1 comprises the outflow valve mechanism 40, and the fluid-storing portion 80 comprises the inflow valve mechanism 90 inside the opening portion 81. Likewise, in the fifth embodiment, the fluid discharge pump 1 comprises the outflow valve mechanism 160, and the fluid-storing portion 80 comprises the inflow valve mechanism 170 inside the opening portion 81.

Figure 17A:
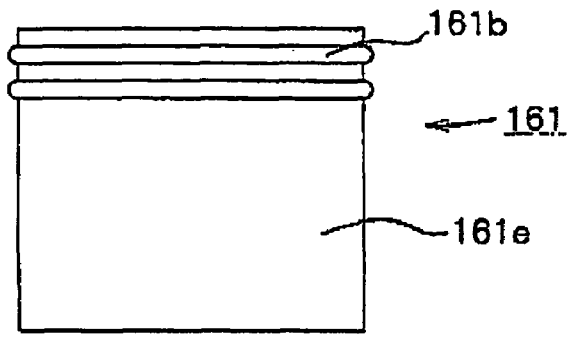
FIG. 17(*a*), a side view, FIG. 17(*b*), a cross sectional view, and FIG. 17(*c*), a bottom view, show explanatory diagrams of a valve portion 161, which forms an outflow valve mechanism 160 in an embodiment of a fluid discharge pumping apparatus according to the present invention.
Figure 17B:
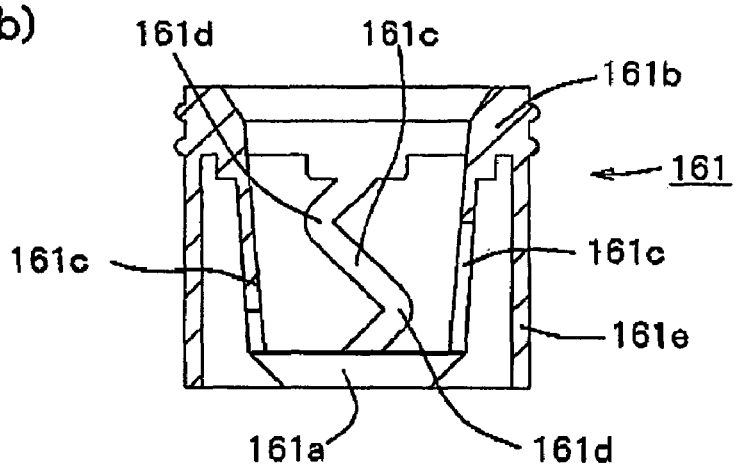
Figure 17C:
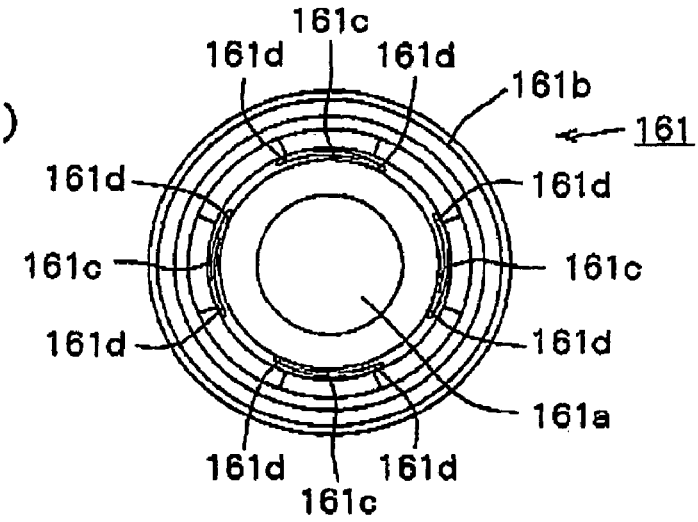
Figure 18A:
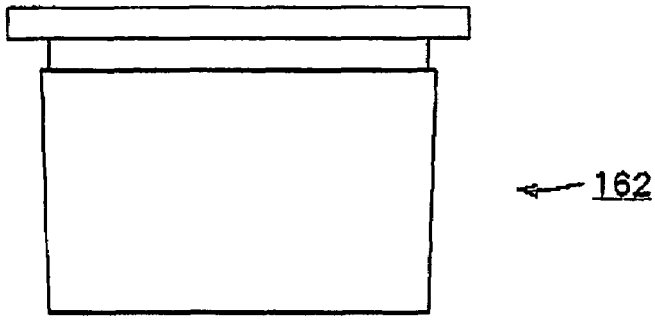
FIG. 18(*a*), a side view, FIG. 18(*b*), a cross sectional view, and FIG. 18(*c*), a bottom view, show explanatory diagrams of a valve seat portion 162, which forms an outflow valve mechanism 160 in an embodiment of a fluid discharge pumping apparatus according to the present invention.
Figure 18B:
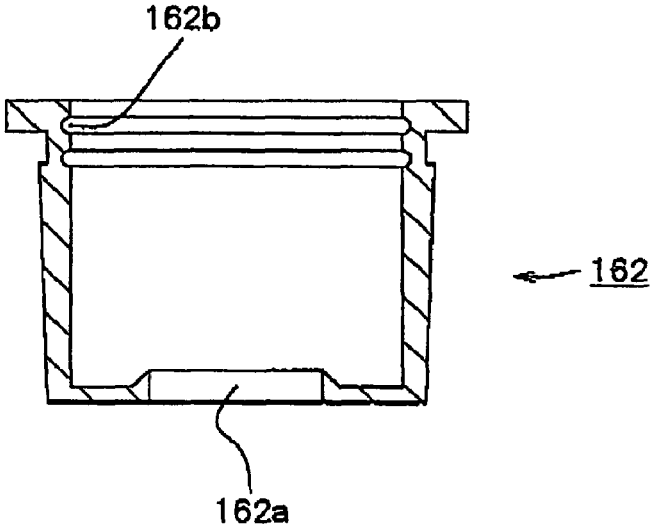
Figure 18C:
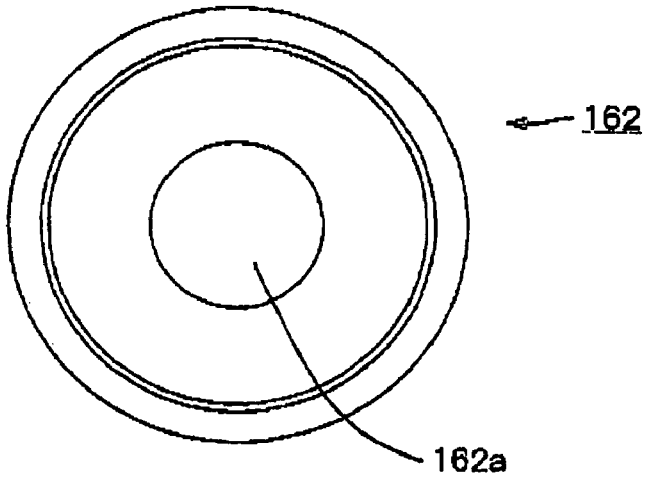

FIG. 17(*a*), a side view, FIG. 17(*b*), a cross sectional view, and FIG. 17(*c*), a bottom view, show explanatory diagrams of a valve portion 161, which forms an outflow valve mechanism 160 in the fifth embodiment of the fluid discharge pumping apparatus according to the present invention. FIG. 18(*a*), a side view, FIG. 18(*b*), a cross sectional view, and FIG. 18(*c*), a bottom view, show explanatory diagrams of a valve seat portion 162, which forms an outflow valve mechanism 160 in the fifth embodiment of the fluid discharge pumping apparatus according to the present invention.

As with the valve seat portion 42 in the first embodiment, the valve seat portion 162 in the outflow valve mechanism 160 is cylindrically-shaped and has an opening portion 162*a* at its bottom which serves as a valve seat. An annular concave portion 162*b* is formed in an upper inner wall of the valve seat portion 162.

The valve portion 161 comprises a supporting portion 161*b* which is disposed inside the valve seat portion 162, and a valve body 161*a* having a shape corresponding to the circular shape of the opening portion 162 of the valve seat portion 162, and further, four connection portions 161*c* connecting the supporting portion 161*b* and the valve body 161*a*. The four connecting portions 161*c* each have a pair of elbow-shaped bends 161*d*. The valve portion 161 further comprises a reinforcement portion 161*e* which encloses the valve body 161*a* and the connecting portions 161*c* and which extends from the supporting portion 161*b*. Accordingly, during molding and assembly processes of the valve body 161*a*, the reinforcement portion 161*e* can protect the connecting portions 161*c*, thereby preventing degradation of the quality of the fluid discharging pump 1.

Incidentally, the inflow valve mechanism 170 shown in FIG. 16 has a configuration identical to that of the inflow valve mechanism 160 shown in FIGS. 17 and 18.

Figure 19:
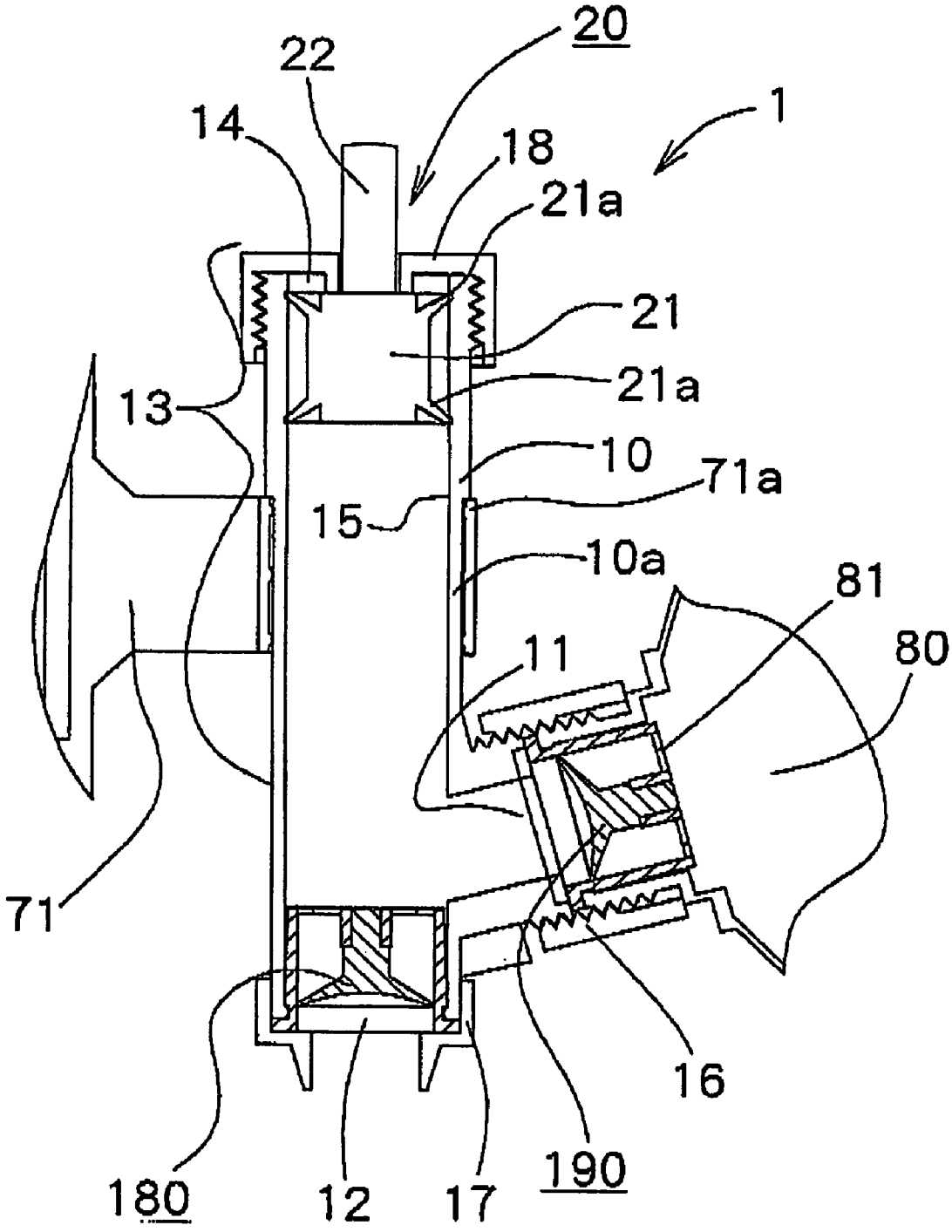
FIG. 19 is a longitudinal sectional view of a discharge pump 1 in a fluid discharge pumping apparatus according to an embodiment of the present invention.

FIG. 19 is a longitudinal sectional view of a discharge pump 1 in a fluid discharge pumping apparatus according to a sixth embodiment of the present invention.

In the first embodiment of the present invention, the fluid discharge pump 1 comprises the outflow valve mechanism 40, and the fluid-storing portion 80 comprises the inflow valve mechanism 90 inside the opening portion 81. Likewise, in the sixth embodiment, the fluid discharge pump 1 comprises the outflow valve mechanism 180, and the fluid-storing portion 80 comprises the inflow valve mechanism 190 inside the opening portion 81.

Figure 20A:
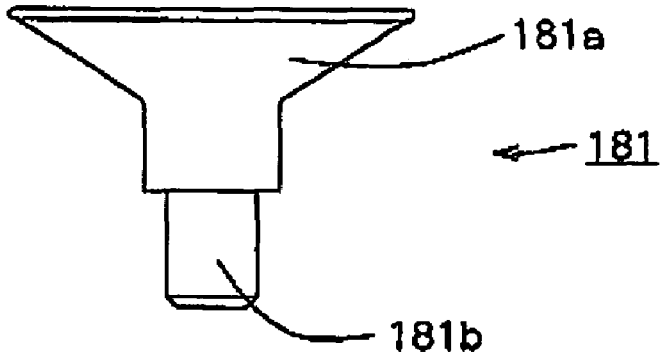
FIG. 20(*a*), a side view, FIG. 20(*b*), a cross sectional view, and FIG. 20(*c*), a bottom view, show explanatory diagrams of a valve portion 181, which forms an outflow valve mechanism 180 in an embodiment of a fluid discharge pumping apparatus according to the present invention.
Figure 20B:
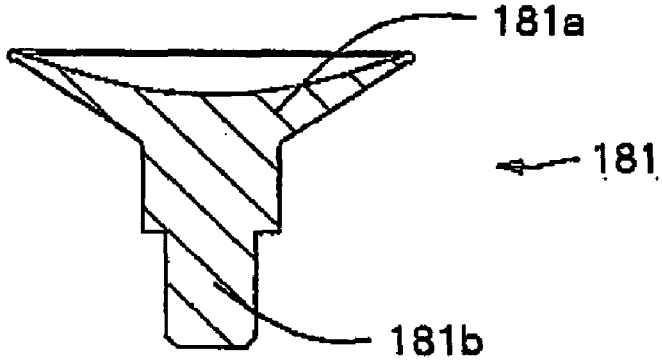
Figure 20C:
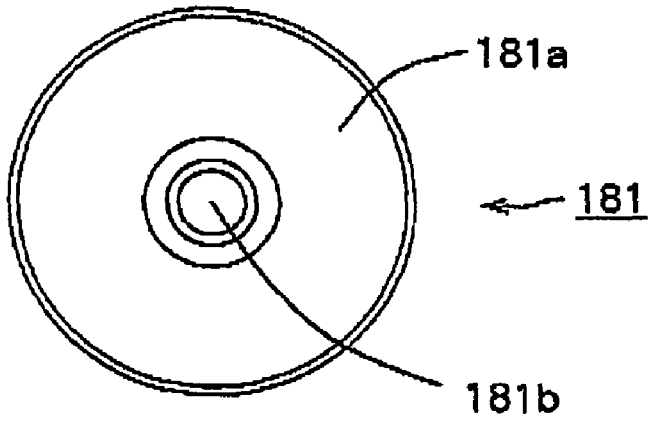
Figure 21A:
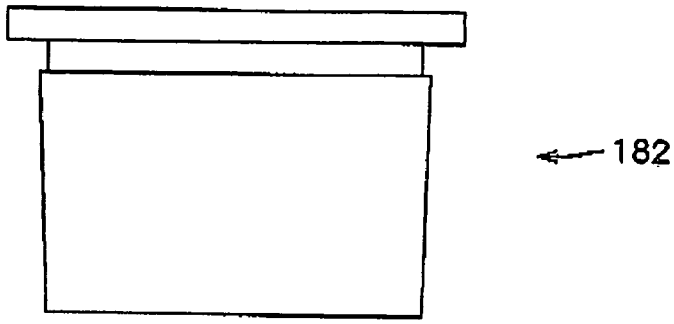
FIG. 21(*a*), a side view, FIG. 21(*b*), a cross sectional view, and FIG. 21(*c*), a bottom view, show explanatory diagrams of a valve seat portion 182, which forms an outflow valve mechanism 180 in an embodiment of a fluid discharge pumping apparatus according to the present invention.
Figure 21B:
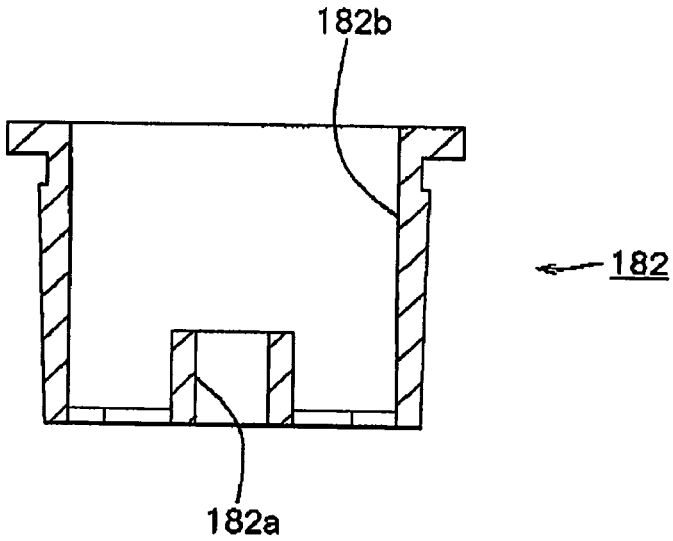
Figure 21C:
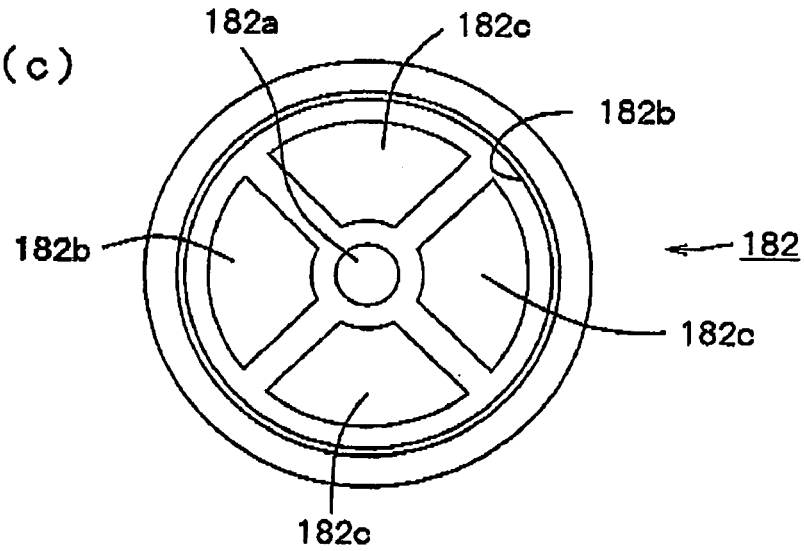

FIG. 20(*a*), a side view, FIG. 20(*b*), a cross sectional view, and FIG. 20(*c*), a bottom view, show explanatory diagrams of a valve portion 181, which forms an outflow valve mechanism 180 in this embodiment of a fluid discharge pumping apparatus according to the present invention. FIG. 21(*a*), a side view, FIG. 21(*b*), a cross sectional view, and FIG. 21(*c*), a bottom view, show explanatory diagrams of a valve seat portion 182, which forms an outflow valve mechanism 180 in an embodiment of a fluid discharge pumping apparatus according to the present invention.

The valve portion 181 of the outflow valve mechanism 180 is flexible and comprises the valve body 181*a* which extends from the center in a radius direction, and the supporting portion 181*b* which extends from the valve body 181*a*.

The valve seat portion 182 of the outflow valve mechanism 180 comprises the valve portion supporting portion 182*a* which supports the valve portion 181, and the valve seat portion 182*b* having a shape corresponding to the valve body 181*a*. Further, around the valve portion supporting portion 182*a*, the valve seat portion 182 has four opening portions 182*c* through which gas or liquid can pass.

The number of opening portions 182*c* formed in the valve seat portion 182 is not limited to four, and can be any number which is two or larger. The opening portions 182 formed in the valve seat portion 182 are preferably disposed uniformly around the valve portion supporting portion 182*a* in order to prevent inadequate localization of inflow or outflow of gas or liquid.

Incidentally, the inflow valve mechanism 190 shown in FIG. 19 has a configuration identical to that of the inflow valve mechanism 180 shown in FIGS. 20 and 21.

According to the outflow valve mechanism 180 of the sixth embodiment, when the pressure inside the cylinder 10 is increased, a periphery of the valve body 181*a* is separated from the valve seat portion 182*b* due to flexibility of the valve body 181*a*, whereby a fluid is discharged outside the cylinder 10. On the other hand, when the interior of the cylinder is not pressurized, the periphery of the valve body 181*a* becomes in contact with the valve seat portion 182*b* again, due to flexibility of the valve body 181*a*, thereby stopping the fluid inside the cylinder 10 from flowing out. Further, when the pressure of the interior of the first fluid-storing container 80 becomes higher than that inside the cylinder 10, the fluid inside the first fluid-storing container 80 flows into the interior of the cylinder 10, due to the function of the inflow valve mechanism 190 having the same configuration as the outflow valve mechanism 180. On the other hand, when the pressure of the interior of the fluid-storing container 80 is equal to or less than that of the interior of the cylinder 10, the function of the inflow valve mechanism 190 stops the fluid inside the first fluid-storing container 80 from flowing into the interior of the cylinder 10.

This application claims priority to Japanese Patent Application No. 2003-087958, Mar. 27, 2003, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A fluid discharge pumping apparatus comprising:

a drive mechanism;

a cylinder having a discharge port at a lower end, a supply port on a side in the vicinity of the discharge port, and a top opening;

an outflow valve mechanism coupled to the discharge port of the cylinder;

an inflow valve mechanism coupled to the supply port of the cylinder;

a piston member capable of reciprocating inside the cylinder;

a piston-supporting member attached to the piston member and extending through the top opening of the cylinder and coupled to the drive mechanism, wherein the piston-supporting member is driven by the drive mechanism to move the piston member in a predetermined range inside the cylinder where the piston member does not block the inflow valve mechanism; and a housing for the drive mechanism, wherein the housing is provided with a cylinder-supporting member having a gripper for detachably gripping the cylinder in a direction perpendicular to the axis of the cylinder, wherein the cylinder, the outflow valve mechanism, and the piston member are co-axially aligned, and an axis of the inflow valve mechanism is directed toward the lower end of the cylinder and acutely angled with respect to the axis of the cylinder, wherein the inflow valve mechanism opens when an interior of the cylinder is depressurized, whereas the outflow valve mechanism opens when the interior of the cylinder is pressurized.

2. The fluid discharge pumping apparatus according to claim 1, further comprising a fluid-storing container which is connected to the supply port, wherein a fluid stored in the fluid-storing container flows into the interior of the cylinder through the inflow valve mechanism and is discharged from the outflow valve mechanism.

3. The fluid discharge pumping apparatus according to claim 2, wherein the inflow valve mechanism is attached to the fluid-storing container.

4. The fluid discharge pumping apparatus according to claim 1, wherein the piston-supporting member is detachably coupled to the drive mechanism.

5. The fluid discharge pumping apparatus according to claim 1, wherein the drive mechanism comprises a motor, gears, and a ball screw, wherein the piston-supporting member is engaged with the ball screw.

6. The fluid discharge pumping apparatus according to claim 5, wherein the ball screw is engaged with the motor via the gears, and is disposed parallel to the piston-supporting mechanism.

7. The fluid discharge pumping apparatus according to claim 6, further comprising a controller which controls revolution of the motor and changes a traveling stroke of the piston-supporting member to change a fluid discharge amount.

8. The fluid discharge pumping apparatus according to claim 2, further comprising a connection mechanism which detachably connects the fluid-storing container to the supply port.

9. The fluid discharge pumping apparatus according to claim 1, further comprising a connection mechanism to detachably connect a fluid-receiving container to the discharge port of the cylinder.

10. The fluid discharge pumping apparatus according to claim 1, wherein the outflow valve mechanism and the inflow valve mechanism are one-way valves which respectively comprise a resin valve seat having an opening portion, and a resin valve body having a shape corresponding to a shape of the opening portion, wherein the valve body closes the opening portion when no pressure is exerted, and the valve body moves to open the opening portion when the interior of the cylinder is pressurized.

11. The fluid discharge pumping apparatus according to claim 9, wherein the valve body, the valve seat, and the opening portion are disposed co-axially.

12. The fluid discharging pumping apparatus according to claim 9, wherein the valve body and the valve seat are integrated or assembled to provide a single valve mechanism unit.

13. The fluid discharge pumping apparatus according to claim 1, wherein the gripper has multiple convex portions for preventing the cylinder from slipping from the gripper.

14. A fluid discharge pumping apparatus comprising:

a drive mechanism to which a piston-supporting member is attached, which reciprocates in a generally vertical direction;

a cylinder disposed in a generally vertical direction, said cylinder having a discharge port at a lower end, a supply port on a side in the vicinity of the discharge port, and a top opening, wherein the discharge port is provided with a one-way valve, and the supply port is provided with a one-way valve;

a piston member capable of reciprocating inside the cylinder, wherein the piston-supporting member is attached to the piston member through the top opening of the cylinder, and the piston-supporting member moves the piston member along an axis of the cylinder; and a housing for the drive mechanism, wherein the housing is provided with a cylinder-supporting member having a gripper for detachably griping the cylinder in a direction perpendicular to the axis of the cylinder, wherein the cylinder, the one-way valve at the discharge port, and the piston member are co-axially aligned, and an axis of the one-way valve at the supply port is directed toward the lower end of the cylinder and acutely slanted with respect to the axis of the cylinder, wherein the one-way valve at the supply port opens when the piston moves upwards, whereas the one-way valve at the discharge port opens when the piston moves downwards.

15. The fluid discharge pumping apparatus according to claim 14, further comprising a fluid-storing container which is connected to the supply port.

16. The fluid discharge pumping apparatus according to claim 15, wherein the one-way valve is attached to a neck portion of the fluid-storing container, and the neck portion is detachably connected to the supply port.

17. The fluid discharge pumping apparatus according to claim 14, wherein the drive mechanism comprises a motor, gears, and a ball screw disposed in a generally vertical direction, wherein the piston-supporting member is engaged with the ball screw.

18. The fluid discharge pumping apparatus according to claim 17, further comprising a controller which controls revolution of the motor and changes a traveling stroke of the piston-supporting member to change a fluid discharge amount.

19. The fluid discharge pumping apparatus according to claim 15, further comprising a connection mechanism which detachably connects the fluid-storing container to the supply port.

20. The fluid discharge pumping apparatus according to claim 14, further comprising a connection mechanism to detachably connect a fluid-receiving container to the discharge port of the cylinder.

21. The fluid discharge pumping apparatus according to claim 14, wherein the one-way valves respectively comprise a resin valve seat having an opening portion, and a resin valve body having a shape corresponding to a shape of the opening portion, wherein the valve body closes the opening portion when no pressure is exerted, and the valve body moves to open the opening portion when the interior of the cylinder is pressurized.

22. The fluid discharge pumping apparatus according to claim 21, wherein the valve body, the valve seat, and the opening portion are disposed co-axially.

23. The fluid discharge pumping apparatus according to claim 14, wherein the gripper has multiple convex portions for preventing the cylinder from slipping from the gripper.

* * * * *